US012296227B2

(12) United States Patent
Bui

(10) Patent No.: US 12,296,227 B2
(45) Date of Patent: May 13, 2025

(54) MULTI-MODAL PORTABLE EXERCISE EQUIPMENT

(71) Applicant: Alexander Bui, Westminster, CA (US)

(72) Inventor: Alexander Bui, Westminster, CA (US)

( * ) Notice: Subject to any disclaimer, the term of this patent is extended or adjusted under 35 U.S.C. 154(b) by 80 days.

(21) Appl. No.: 17/933,493

(22) Filed: Sep. 20, 2022

(65) Prior Publication Data

US 2023/0103853 A1 Apr. 6, 2023

Related U.S. Application Data

(60) Provisional application No. 63/246,816, filed on Sep. 22, 2021.

(51) Int. Cl.

| | |
|---|---|
| ***A63B 26/00*** | (2006.01) |
| ***A63B 21/00*** | (2006.01) |
| ***A63B 23/12*** | (2006.01) |
| ***A63B 43/02*** | (2006.01) |

(52) U.S. Cl.

CPC ..... *A63B 26/003* (2013.01); *A63B 21/151* (2013.01); *A63B 23/12* (2013.01); *A63B 43/02* (2013.01)

(58) Field of Classification Search

CPC . A63B 21/06; A63B 21/0601; A63B 21/0604; A63B 21/0607; A63B 65/06

See application file for complete search history.

(56) References Cited

U.S. PATENT DOCUMENTS

| | | | | |
|---|---|---|---|---|
| 6,461,285 | B1 | 10/2002 | Theunissen et al. | |
| 6,575,885 | B1 | 6/2003 | Weck et al. | |
| 7,494,446 | B2 | 2/2009 | Weck et al. | |
| 8,882,642 | B2 * | 11/2014 | Chavez | A63B 23/03575 482/121 |
| 9,999,807 | B2 | 6/2018 | Rainey | |
| 2003/0100408 | A1 * | 5/2003 | Chuang | A63B 21/222 482/44 |
| 2007/0225133 | A1 * | 9/2007 | Castro | A63B 21/0004 482/121 |
| 2012/0053024 | A1 * | 3/2012 | Mendoza | A63B 21/0722 482/106 |

(Continued)

*Primary Examiner* — Zachary T Moore

(74) *Attorney, Agent, or Firm* — Albert Peter Durigon

(57) ABSTRACT

The multi-modal portable exercise equipment of the present invention includes a zippered skin and matable first and second generally hemispheric exercise half bodies that in mated condition provide a generally spherical exercise ball. The exercise ball, or another ball such as an ordinary basketball, is inserted in the skin and attached to external exercise equipment such as the cable of an exercise machine or resistance band and can be used by a subject for strength and other allied training exercises. In another exercise modality thereof the first and second generally hemispheric exercise half bodies in unmated condition each provide a freestanding generally hemispheric exercise half body and can be used by a subject for balance and other allied training exercises. The first and second generally hemispheric exercise half bodies in unmated condition are each constituted of a plurality of spherical caps in nested relation that may be unpacked and used by a subject for balance and other allied training exercises of low, medium and high use difficulty.

8 Claims, 25 Drawing Sheets

(56) References Cited

U.S. PATENT DOCUMENTS

| | | | | |
|---|---|---|---|---|
| 2012/0157270 | A1* | 6/2012 | Johnson | A63B 21/072<br>482/93 |
| 2019/0111308 | A1* | 4/2019 | Naomi | A63B 21/4011 |
| 2020/0269107 | A1* | 8/2020 | Whiting | A63B 21/075 |

* cited by examiner

MULTI-MODAL PORTABLE EXERCISE EQUIPMENT

CROSS-REFERENCE TO RELATED APPLICATIONS

The instant application claims priority to provisional application 63/246,816, filed 22 Sep. 2021, of the same inventive entity as herein, incorporated herein by reference.

FIELD OF THE INVENTION

This invention is drawn to the field of fitness and sports training devices, and more particularly, to a multi-modal portable exercise equipment for sports and fitness training and physical therapy/rehabilitation.

BACKGROUND OF THE INVENTION

It is well-known that the science, art and discipline of physical culture imparts bodily strength and physical beauty to those who regularly undergo gymnastic, calisthenic and other exercises and helps to promote not only physical health but also an overall state of general mental and emotional well-being. Strength training involves the performance of physical exercises which are designed to improve strength and endurance. Power training typically involves exercises which apply the maximum amount of force as fast as possible. Such strength and power training is often associated with the use of weights or resistance bands.

When performed properly, strength and power training exercises can provide significant functional benefits and improvement in overall health and well-being, including increased bone, muscle, tendon and ligament strength and toughness, improved joint function, reduced potential for injury, increased bone density, increased metabolism, increased fitness and improved cardiac function. Any exercise movements that include pushing, pulling, rotating, squats, lunges, and bending are examples of strength and power training.

In addition to strength and power training, there are also exercises designed to provide core strength, stability strength, and balance strength. Core strength is a person's ability to stabilize their core. Abdominal muscles, back muscles, and muscles around the pelvis are muscles that are involved in core exercises. Planks and side planks are representative core strength exercises. Stability strength may be defined as allowing wanted movement while resisting unwanted movement. Stability is about timing and sequential activation of muscles. Holding a plank or side plank in a perfect position are examples of stability strength. Balance strength may be defined as the ability to control or the process of maintaining the center of gravity within the body's base of support within a given sensory environment. There are static and dynamic forms of balance. Static balance is the ability of a stationary subject to maintain balance when at rest, whereas dynamic balance is the ability to balance while in motion or when switching between positions, the need for which as will be readily appreciated is encountered all the time in everyday life as well as in the world of athletics. Being in a lunge or a single leg position are examples of balance strength.

It is well-known that the use of exercises involving medicine balls, wall balls, slam balls and the inflatable BOSU half balls of U.S. Pat. Nos. 7,494,446 and 6,575,885, and the half balls of U.S. Pat. Nos. 9,999,807 and 6,461,285, help to provide among others core strength, stability strength and balance strength.

As will be readily appreciated both general populations as well as athletes need to work with each of these variables (core strength, stability strength, balance strength, strength training, and power training) to regain and/or to retain the ability to perform every day life's tasks, to achieve their fitness goals and physical therapy/rehabilitation goals, as well as to perform better in their chosen sport. However, not only is access to high-quality training equipment generally limited for much of the population due to economic and logistical constraints but the heretofore known half balls are disadvantageous insofar as they generally can only be used for a limited range of exercises, cannot fit easily into a gym bag, and/or are costly.

SUMMARY OF THE INVENTION

Accordingly, it is the general object of the present invention to disclose novel multi-modal portable exercise equipment to improve access to training equipment.

Another general object of the present invention is to provide multi-modal portable exercise equipment that can enhance one's core strength, balance, stability, muscular strength and power.

Another object of the present invention is to disclose a multi-modal portable exercise equipment that enhances fitness/physical therapy or rehabilitation in everyday life situations, promotes achieving fitness and physical therapy/rehabilitation goals and helps athletes perform better in their sport.

Another object of the present invention is to disclose a multi-modal portable exercise equipment that synergistically combines in one both the utility of training with balance balls and the utility of training with resistance bands and exercise machine cables.

A further object of the present invention is to disclose a multi-modal portable exercise equipment of size and weight that is storable in and transportable by a back pack and of a construction that may be manufactured at comparatively-low cost.

In one presently preferred embodiment, the multi-modal portable exercise equipment of the present invention comprises matable first and second generally hemispheric exercise half bodies that in mated condition cooperate to provide a generally spherical exercise ball and that in unmated condition each provide a freestanding generally hemispheric exercise half body.

A generally spherical circumferentially zippered skin receives the generally spherical exercise ball provided by the matable first and second generally hemispheric exercise half bodies in their mated condition. An attachment member to releasably attach onto a resistance band or weight cable of an exercise machine is fixed to the generally spherical circumferentially zippered skin.

The generally spherical circumferentially zippered skin may also be adapted to receive a generally spherical sports ball therewithin, such as a conventional basketball, softball, baseball, volleyball, soccer ball, and the like without departing from the inventive concepts.

In one presently preferred embodiment, first and second antipodal attachment members are respectively attached at each of the opposing North and South poles of the generally spherical circumferentially zippered skin. First and second force balancing strips, preferably attached to the inside of the generally spherical skin, respectively extend between the first and second antipodal attachment members on opposing sides of the skin. The first and second force balancing strips extending therebetween substantially prevent tearing of the first and second antipodal attachment members off of the skin during exercise training.

In one presently preferred embodiment, the generally hemispheric exercise half bodies in unmated condition each include a plurality of differently sized spherical caps that are adapted to fit together in interfitting nested relation and that when unpacked are cooperative to selectably provide free-standing spherical domes of different use difficulty.

The plurality of differently sized spherical caps adapted to fit in interfitting nested relation of the generally hemispheric exercise half bodies include a spherical cap of a first type that is received by but does not receive another spherical cap; a spherical cap of a second type that receives but is not received by another spherical cap; and a spherical cap of a third type that both receives and is received by another spherical cap.

The spherical cap of the first type includes a flat surface face to stand upon. The spherical caps of the second and third type each include an annular portion in the same plane as its base. The annular portions surround a central opening that opens inwardly into a central hollow having walls defining a concave spherical cavity. The height and radius of the concave spherical cavities of the spherical caps of the second and third types are of the same height and radius as the spherical caps they receive and the diameters of the openings thereof are of the same diameter as the bases of the spherical caps they receive in nested relation.

Received in the skin provided therefor the generally spherical exercise ball provided by the first and second generally hemispheric exercise half bodies in mated condition of the multi-modal portable exercise equipment of the present invention in one exercise modality is attached onto an external band, resistance band or cable by the skin's attachment member and a subject is able to hold the ball with one or two hands to perform mainly core strength exercises, muscular strength, and power as well as balance and stability exercises in multiple directions and can be able to push, pull, bend, flex, extend, rotate with/without squats, lunges, bend (hinge) movements from the lower extremity. A subject can also be able to be in a bilateral (both feet), unilateral (single leg), and staggered (split squat i.e., e.g. left foot in front, right foot back) stance and thereby incorporate together both lower body movements along with the upper body movements.

In another exercise modality, a subject can be able to perform different squat variations while standing (or otherwise supported) on each of the stand-alone first and second generally hemispheric exercise half bodies in their unmated condition and/or on selected ones of the constitutive spherical caps thereof of the multi-modal portable exercise equipment of the present invention, either with the spherical metastable sides or the flat, stable sides thereof on the ground. A subject can be able to do therewith single leg exercises, split squat exercises, side lunge exercises, push-ups, side planks, and planks. During the lower body movements/exercises, a subject can be able to flex, extend, bend (hinge), squat, lunge, and rotate from the joints (hip, knee, ankle).

The constitutive spherical caps adapted to fit in nested relation of the generally hemispheric exercise half bodies of the multi-modal portable exercise equipment of the present invention may advantageously be made at comparatively low-cost of injection-molded plastic or durable foam allowing thereby for greater availability, for both general populations as well as athletes.

BRIEF DESCRIPTION OF THE DRAWINGS

These and other objects, advantageous features and inventive aspects of the present invention will become apparent to those of skill in the art by having reference to the following, solely exemplary, detailed description of the presently preferred embodiments thereof, and to the drawings, wherein.

DETAILED DESCRIPTION OF THE PRESENTLY PREFERRED EMBODIMENTS

Figure 1:
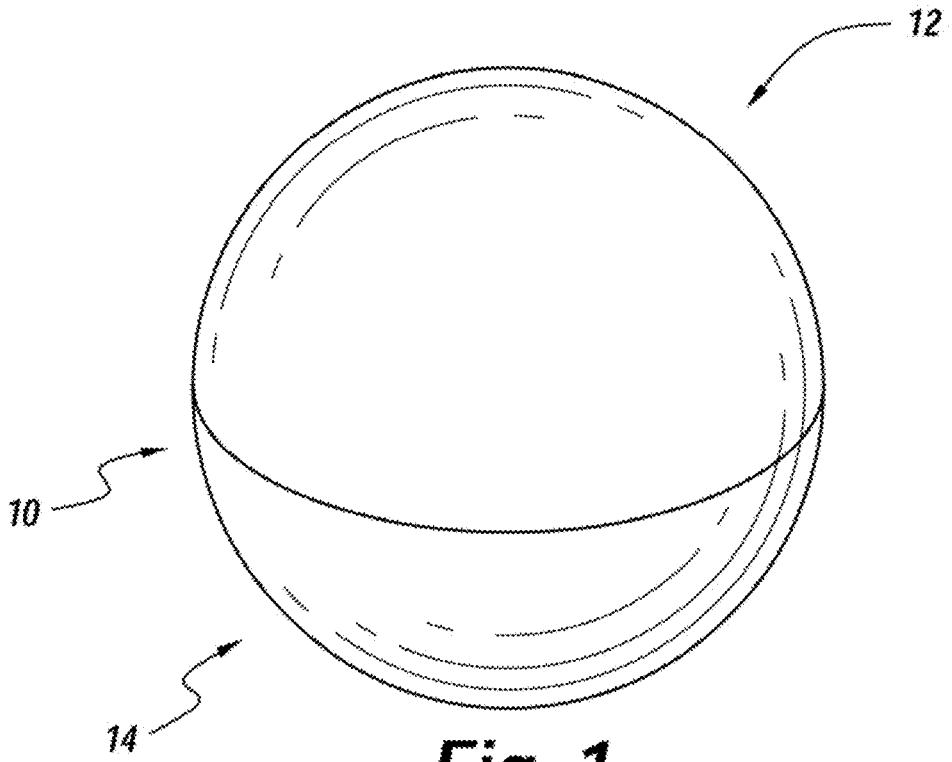
FIG. 1 is a pictorial view showing the multi-modal portable exercise equipment of the present invention.

Referring now to FIG. 1, generally designated at 10 is a pictorial view showing the multi-modal portable exercise equipment of the present invention. The multi-modal portable exercise equipment 10 includes mating first and second generally hemispheric exercise half bodies generally designated 12, 14. The generally hemispheric exercise half bodies 12, 14 each include matable spherical caps to be described that in mated condition define each said generally hemispheric exercise half body and that are cooperative to selectively provide free-standing spherical domes to be described of different height and correspondingly easy, medium and hard use difficulty. As used herein, "spherical cap" and "spherical dome" are interchangeable terms that refer to the geometrical shape defined as a "spherical segment of one base."

Figure 2:
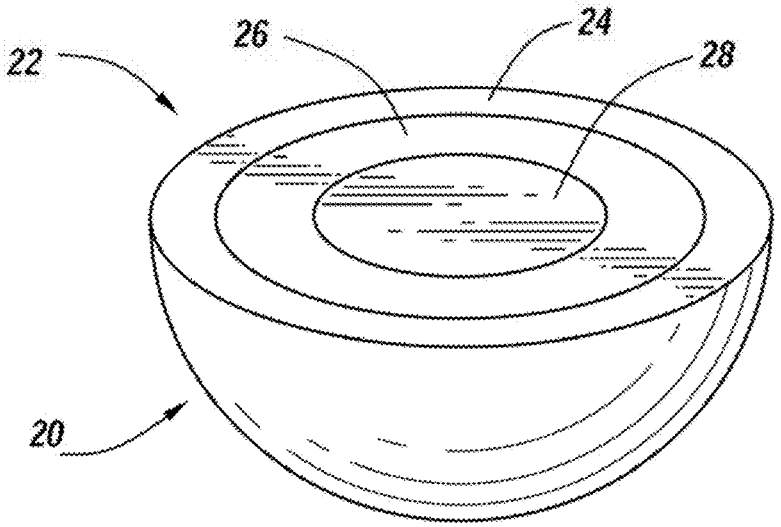
FIG. 2 is a pictorial view of one constitutive generally hemispheric exercise half body of the multi-modal portable exercise equipment of the present invention.

Referring now to FIG. 2, generally designated at 20 is a pictorial view of one constitutive generally hemispheric exercise half body of the multi-modal portable exercise equipment of the present invention. The generally hemispheric exercise half body 20 has a generally circular top face generally designated 22 to be described at the equatorial plane thereof.

The generally hemispheric exercise half body 20 includes a plurality of spherical caps 24, 26, 28 that are adapted to fit together in interfitting nested relation to provide the generally hemispheric exercise half-body 20, as shown, and that when unpacked are cooperative to provide freestanding spherical domes of different use difficulty to be described.

Figure 3:
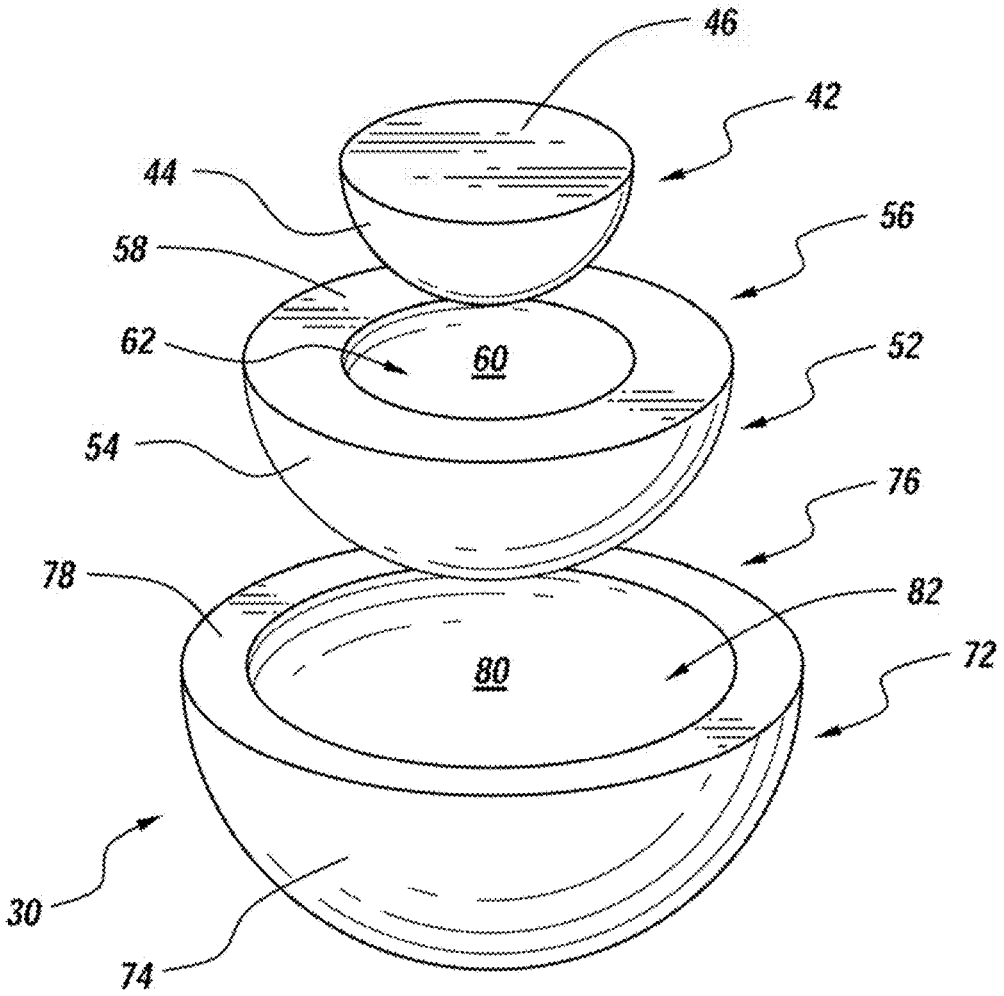
FIG. 3 is an exploded pictorial view of one constitutive generally hemispheric exercise half body of the multi-modal portable exercise equipment of the present invention.

Referring now to FIG. 3, generally designated at 30 is an exploded pictorial view of one constitutive generally hemispheric exercise half body of the multi-modal portable exercise equipment of the present invention. The generally hemispheric exercise half body 30 is comprised of spherical caps generally designated 42, 52, 72 that are adapted to fit together in nested relation such that the spherical cap 42 is received by the spherical cap 52, but itself does not receive another spherical cap; whereas the spherical cap 72 receives the spherical cap 52 but is not received by another spherical cap; and the spherical cap 52 both receives the spherical cap 42 and is received by the spherical cap 72.

The spherical cap 42 is shaped as a spherical segment of one base. As shown, the cap 42 has a body 44 defining a spherically convex outer surface. A flat top 46 adapted to stand upon is provided at and across its base.

The spherical cap 52 likewise is shaped as a spherical segment of one base. As shown, the cap 52 has a body 54 defining a spherically convex outer surface. A top face generally designated 56 to be described is provided at its base. The top face 56 includes an annular portion 58 in the same plane as its base surrounding a circular, central opening generally designated 60, also in the same plane as its base. The circular, central opening 60 opens to an inner concave spherical cavity generally designated 62 defined by the interior walls of the body 54.

The radius of the opening 60 matches in size the radius of the face 46 of the spherical cap 52, and the depth and concavity of the inner concave spherical cavity 62 defined by the inside walls of the body 54 match in size the height and in curvature the spherically convex outer surface of the body 44 of the spherical cap 42.

The spherical cap 72 is shaped as a spherical segment of one base. As shown, the cap 72 has a body 74 defining a spherically convex outer surface. A top face generally designated 76 to be described is provided at its base. The top face 76 includes an annular portion 78 in the same plane as its base surrounding a circular, central opening generally designated 80, also in the same plane as its base. The circular, central opening 80 opens to an inner concave spherical cavity generally designated 82 defined by the interior walls of the body 74.

The radius of the opening 80 matches in size the radius of the face 56, and the depth and concavity of the inner concave spherical cavity 82 defined by the inside walls of the body 74 respectively match in size and curvature the height and the spherically convex outer surface of the body 54 of the spherical cap 52.

Figure 4:
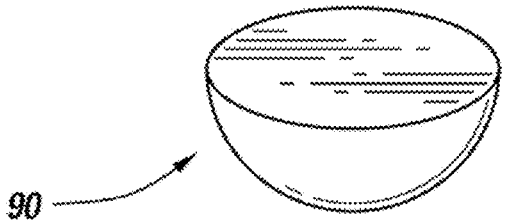
FIG. 4, FIG. 5, and FIG. 6 respectively are pictorial views of the free-standing spherical domes of different height and correspondingly easy, medium and hard use difficulty into which the generally hemispheric exercise half bodies of the multi-modal portable exercise equipment of the present invention may be selectively configured.
Figure 5:
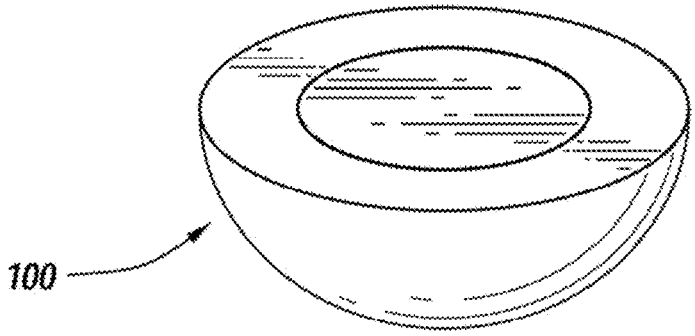
Figure 6:
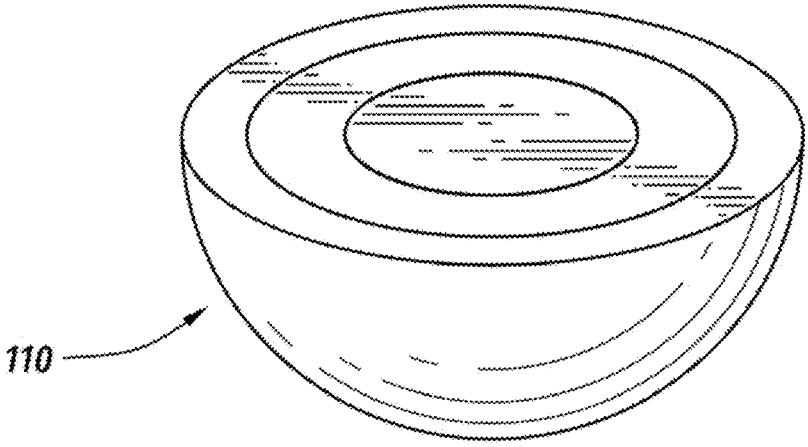

Referring now to FIG. 4, FIG. 5, and FIG. 6, generally designated at 90, 100, and 110 respectively are pictorial views of the freestanding spherical domes of different height and correspondingly easy, medium and hard use difficulty into which the hemispheric exercise half bodies of the multi-modal portable exercise equipment of the present invention may be selectively configured.

Referring now specifically to FIG. 4, generally designated at 90 is the spherical dome of easy use difficulty. The spherical dome of easy use difficulty 90 is constituted by the spherical caps of the generally hemispheric half bodies of the multi-modal portable exercise equipment of the present invention of the type, as described above, that are received by but do not receive another spherical cap. As appears more fully hereinbelow, used to stand thereupon enables a subject to balance thereon and undergo different exemplary exercises that can be able to be performed thereon of easy use difficulty.

Referring now to FIG. 5, generally designated at 100 is the spherical dome of medium use difficulty. The spherical dome of medium use difficulty 100 is constituted by the spherical caps of the generally hemispheric exercise half bodies of the multi-modal portable exercise equipment of the present invention of the type, described above, that are received by but do not receive another spherical cap, in nested relation with the spherical caps of the type, described above, that both receive another spherical cap and are received by another spherical cap. As appears more fully hereinbelow, used to stand thereupon enables a subject to balance thereon and undergo different exemplary exercises that can be able to be performed thereon of medium use difficulty.

Referring now to FIG. 6, generally designated at 110 is the spherical dome of hard use difficulty. The spherical dome of hard use difficulty 110 is constituted by the spherical caps of the generally hemispheric exercise half bodies of the multi-modal portable exercise equipment of the present invention of the type, described above, that receive but are not received by another spherical cap, in nested relation with the spherical caps of the type, described above, that both receive another and are received by another spherical cap, in nested relation with the spherical caps of the type, described above, that are received by but do not receive another spherical cap. As appears more fully below, used to stand thereupon enables a subject to balance thereon and undergo different exemplary exercises that can be able to be performed thereon of hard use difficulty.

Figure 7:
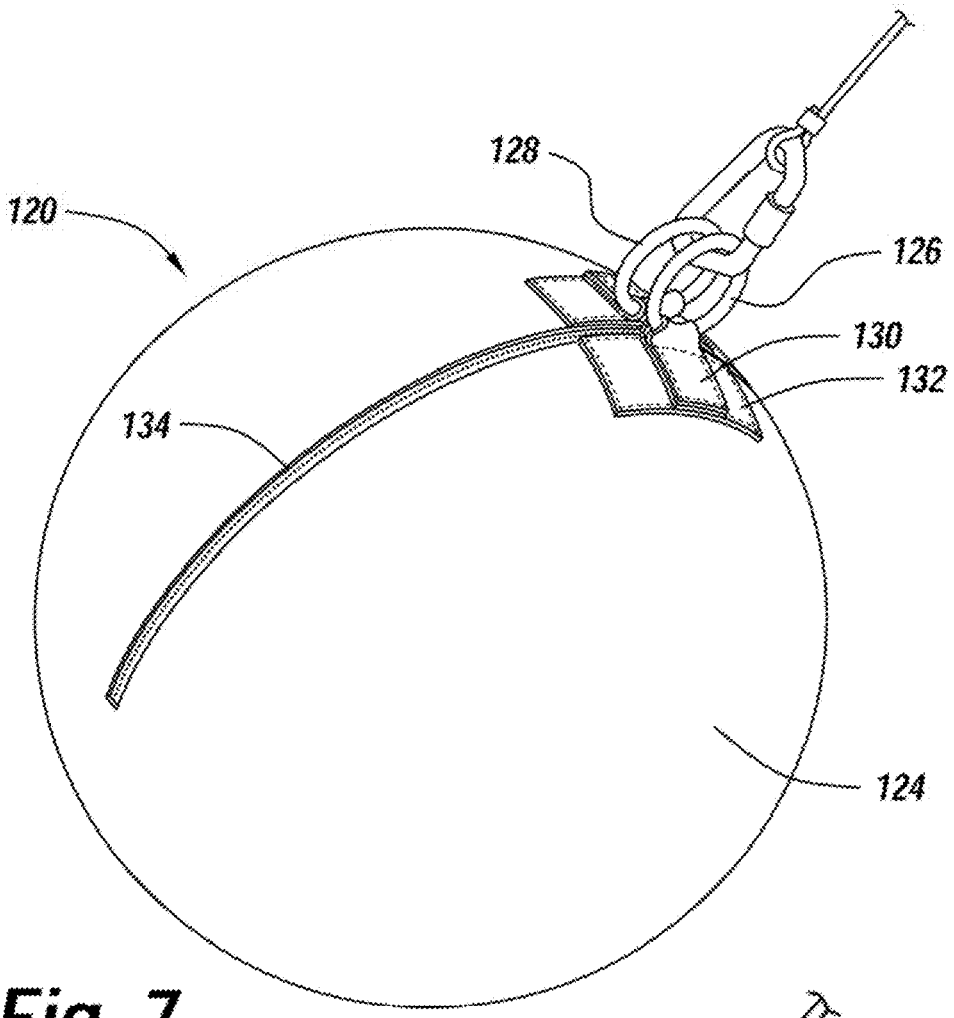
FIG. 7 is a pictorial view and FIG. 8 is a partial pictorial view showing the generally spherical circumferentially zippered skin adapted to receive the first and second generally hemispheric exercise half bodies in mated condition that includes an attachment member to releasably attach to a weight machine's cable or resistance bands of the multi-modal portable exercise equipment of the present invention.
Figure 8:
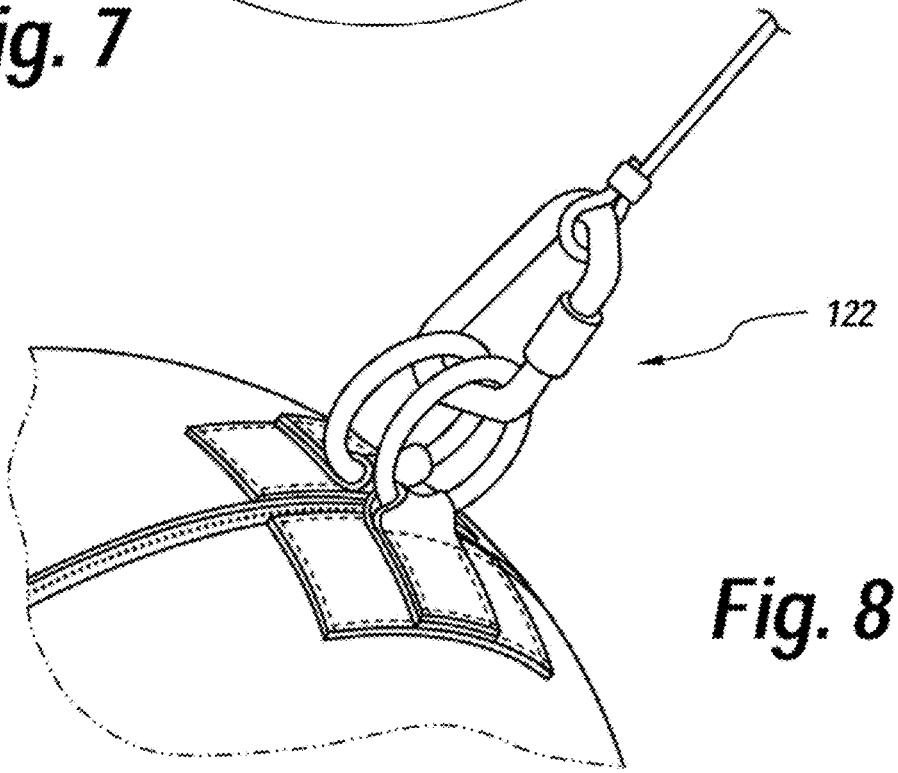

Referring now to FIG. 7, generally designated at 120 is a pictorial view and generally designated at 122 in FIG. 8 is a partial pictorial view showing the generally spherical circumferentially zippered skin adapted to receive the first and second generally hemispheric exercise half bodies in mated condition that includes an attachment member to releasably attach a weight machine's cable of the multi-modal portable exercise equipment of the present invention. As seen therein, circumferentially zippered skin 124 of nylon rip stop material or other thin, flexible and substantially inelastic material or other materials such as leather is sized to removably receive the generally spherical exercise ball of the present invention.

A pair of O-rings 126, 128 are threadably attached to the skin 124. A strip 130, rectangular in shape, is first folded on itself to form a loop end; one of the loose ends of the strip 130 is next inserted into the O-ring 126, such that the loop end of the strip 130 rests against the O-ring 126, and the free ends thereof are brought into confronting relation and threadably fastened together, thereby attaching the strip 130 to the O-ring 126; then the strip 130, with the O-ring 126 attached thereto, is threadably fastened to an anchor patch 132, itself threadably fastened to the generally spherical circumferentially zippered skin 124, whereby the O-ring 126 and skin 124 are fastened together via the strip 130 and anchor patch 132. The O-ring 128 is attached to the skin 124 in the same way as the O-ring 126, but is not separately described again herein for the sake of brevity of explication. The attachment member may also be a single O-ring, not shown, attachment member.

The O-rings 126, 128 in the illustrated embodiment are located on the skin 124 on opposite sides of zipper 134, although in alternate embodiments, the O-rings 126, 128 could be located elsewhere on the skin 124 and a different releasable attachment than a circumferentially extending zipper could be employed without departing from the inventive concepts.

In an alternate embodiment, the circumferentially zippered generally spherical skin 124 may advantageously be sized to receive an ordinary sports ball such as a basketball, not shown, without departing from the inventive concepts.

Figure 9:
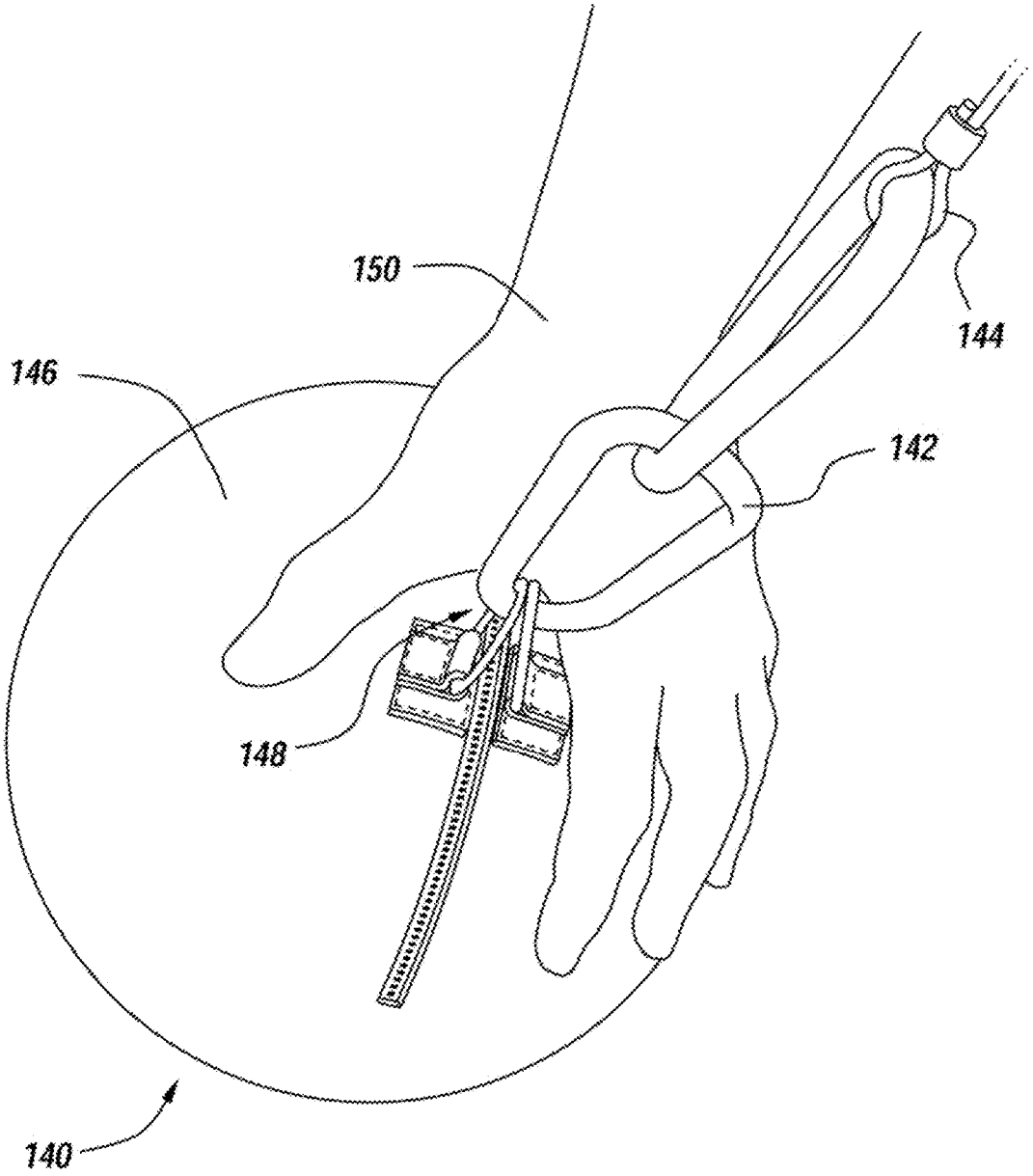
FIG. 9 is a pictorial view useful in explaining the manner of use of the embodiment of FIGS. 7, 8.

Referring now to FIG. 9, generally designated at 140 is a pictorial view useful in explaining the manner of use of the embodiment of FIGS. 7, 8. A carabiner 142 of a weight machine cable 144 is first attached to the skin 146 via the O-rings generally designated 148, and therewith to the generally spherical exercise ball it envelopes, not shown. When the skin enveloped exercise ball is gripped by the palm of the hand so as to straddle the O-rings 148, a subject is enabled to manipulate the ball and undergo different exemplary exercises that can be able to be performed thereby as appears more fully hereinbelow.

Figure 10:
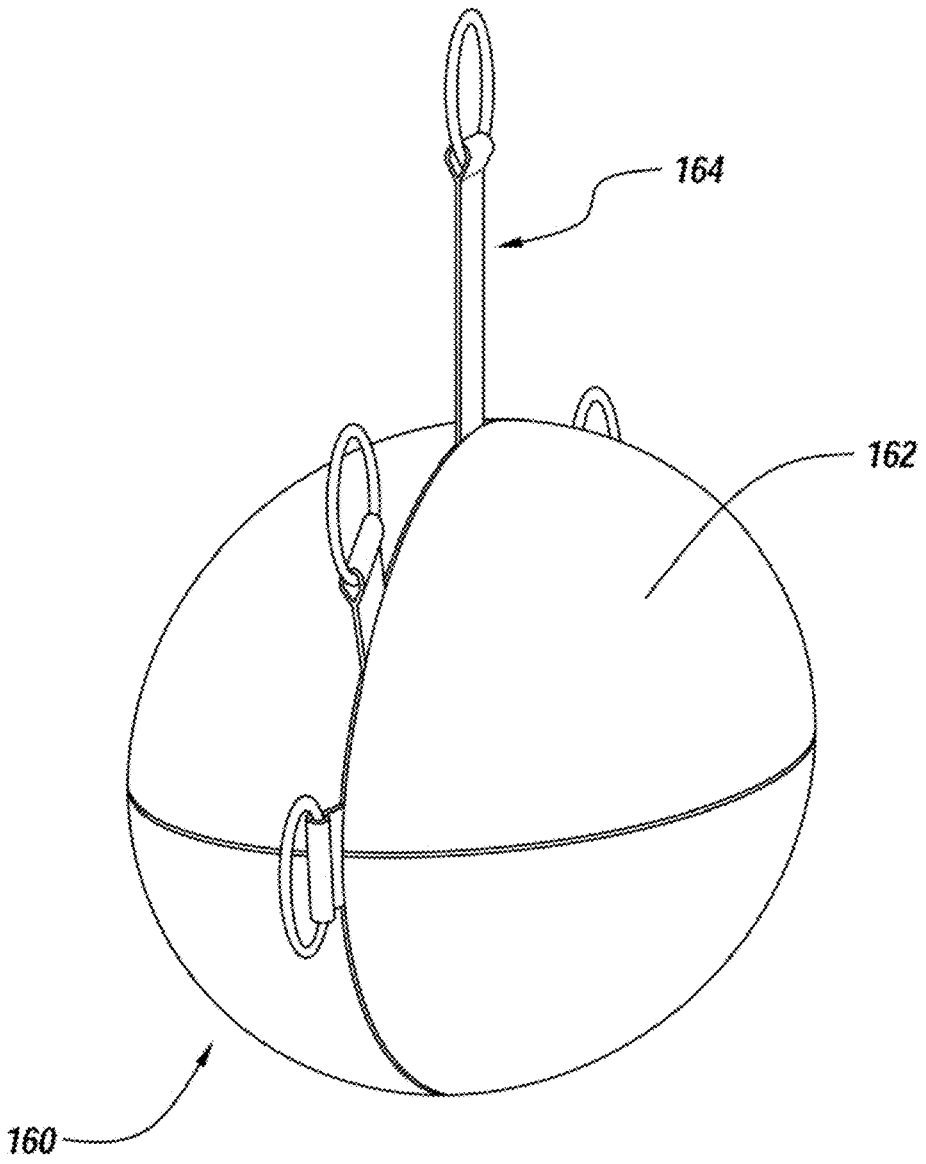
FIGS. 10, 11 are pictorial views respectively showing a generally oval skin adapted to receive first and second generally semioval exercise half bodies in mated condition and/or a standard football that includes multiple attachment members of the multi-modal portable exercise equipment of the present invention.
Figure 11:
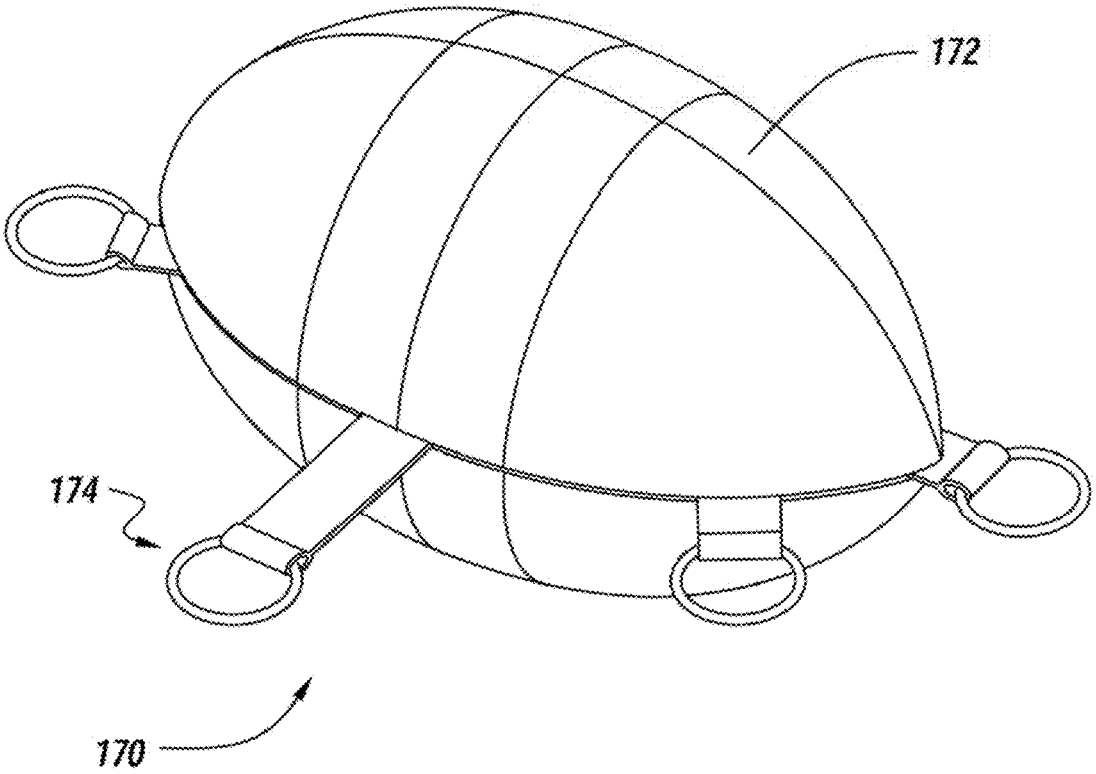

Referring now to FIGS. 10, 11, generally designated at 160 in FIG. 10 and at 170 in FIG. 11 are pictorial views respectively showing a generally oval shaped zippered skin 162, 172 adapted to receive first and second generally semioval exercise half bodies in mated condition, not shown, or a standard football, not shown, that includes multiple attachment members generally designated 164, 174 of the multi-modal portable exercise equipment of the present invention. Preferably the plurality of attachment members 164, 174 are threadably attached to the skin, although they may be adhesively, laser welded or otherwise attached to the oval shaped, circumferentially zippered skin without departing from the inventive concepts.

Figure 12:
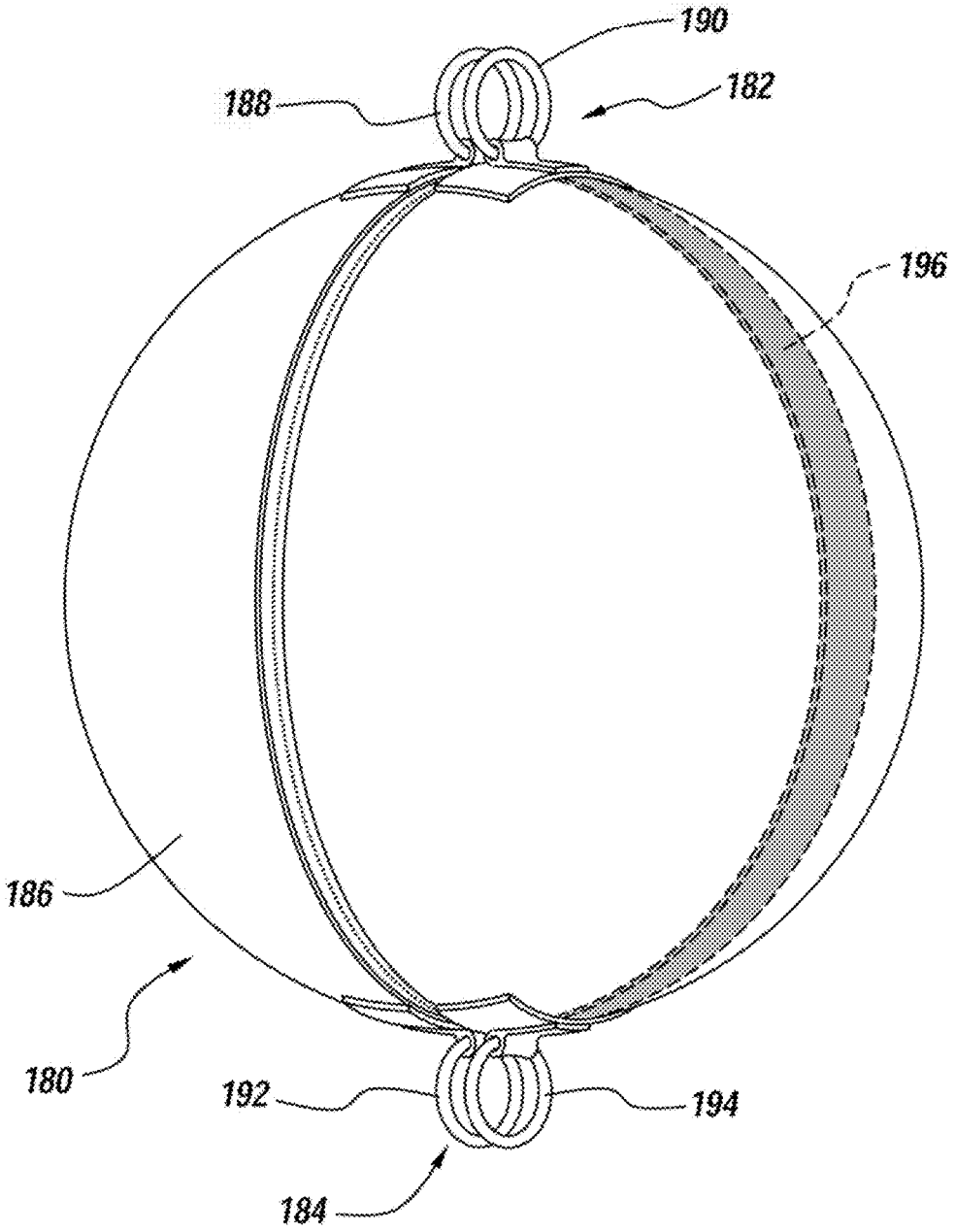
FIG. 12 is a pictorial view showing the generally spherical circumferentially zippered skin adapted to receive the first and second generally hemispheric exercise half bodies in mated condition that includes first and second antipodal attachment members to releasably attach to a weight machine's cable or resistance band of the multi-modal portable exercise equipment of the present invention.

Referring now to FIG. 12, generally designated at 180 is a pictorial view showing a generally spherical circumferentially zippered skin adapted to receive first and second generally hemispheric exercise half bodies in mated condition and/or a standard spherically shaped sports ball such as a basketball, both not shown, that includes first and second antipodal attachment members to releasably attach to a weight machine's cable of the multi-modal portable exercise equipment of the present invention. At the antipodes generally designated 182, 184 of the generally spherical circumferentially zippered skin 186, first and second pairs of O-rings 188, 190 and 192, 194 are respectively attached to the skin 186 in the manner described above in connection with the description of FIGS. 7, 8, not described again herein for the sake of brevity of explication.

A first force balancing strip of fabric or other strong, flexible material 196, such as nylon, is threadably attached along its length to the confronting inside arcuate surface of the skin 186, and, at each of its ends, is threadably attached to respective ones of the anchor patches to which the antipodal O-rings 190, 194 are attached. A second force balancing strip of fabric or other strong, flexible material, such as nylon, not shown, is threadably attached along its length to the confronting inside arcuate surface of the skin 186, and, at each of its ends, is threadably attached to respective ones of the anchor patches to which the antipodal O-rings 188, 192 are attached. The first and second force balancing strips are fastened to the skin in the same equatorial plane on opposing sides of the skin 186.

Figure 13:
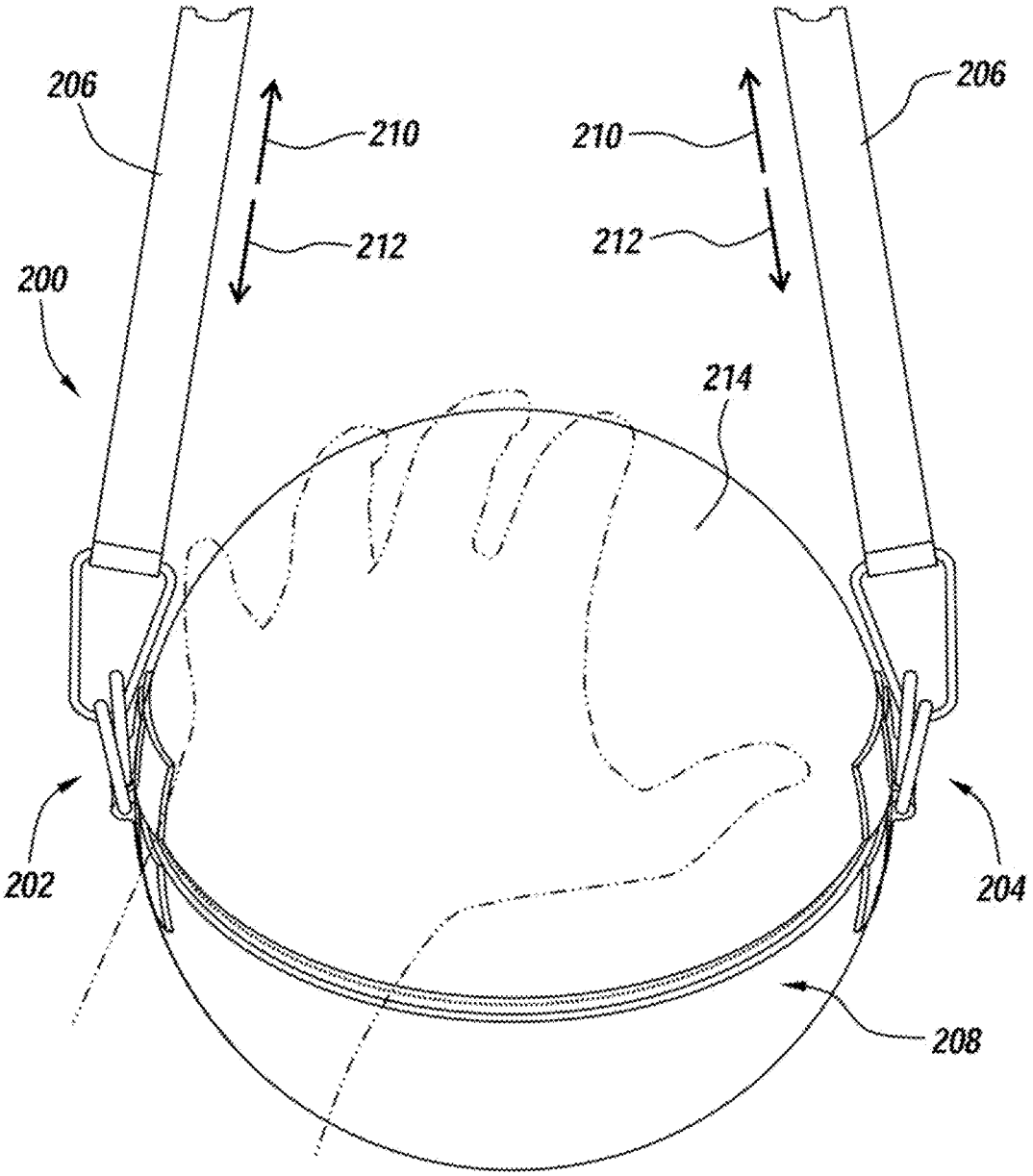
FIG. 13 is pictorial view useful in explaining the manner of use of the embodiment of FIG. 12.

Referring now to FIG. 13, generally designated at 200 is a pictorial view useful in explaining the manner of use of the embodiment of FIG. 12. When the first and second antipodal O-rings generally designated 202, 204 are attached via a strap 206 to the cable end of exercise equipment, not shown, and the exercise ball generally designated 208 is gripped by the palm of the hand between the antipodal O-rings 202, 204 and manipulated, a subject is thereby enabled to undergo different exemplary exercises that can be able to be performed thereby as appears more fully below.

The cable end of the exercise equipment thereby produces forces on the antipodal O-rings 202, 204, schematically illustrated by arrows 210. The forces 210 act to tear the first and second antipodal O-rings 202, 204 from off of the skin 186; however, the force balancing strip, not shown, on the side of the ball 208 opposite the side facing the cable end of the exercise equipment, reacts to the forces 210 exerted on the O-rings 202, 204 and produces counteracting balancing forces, schematically illustrated by arrows 212, which substantially prevent the antipodal O-rings 202, 204 from tearing off of the skin 214.

The force balancing strips and antipodal attachment members could advantageously be incorporated in any skin embodiments in accord with the present invention, such as the generally oval skins of the FIGS. 10, 11.

Figure 14A:
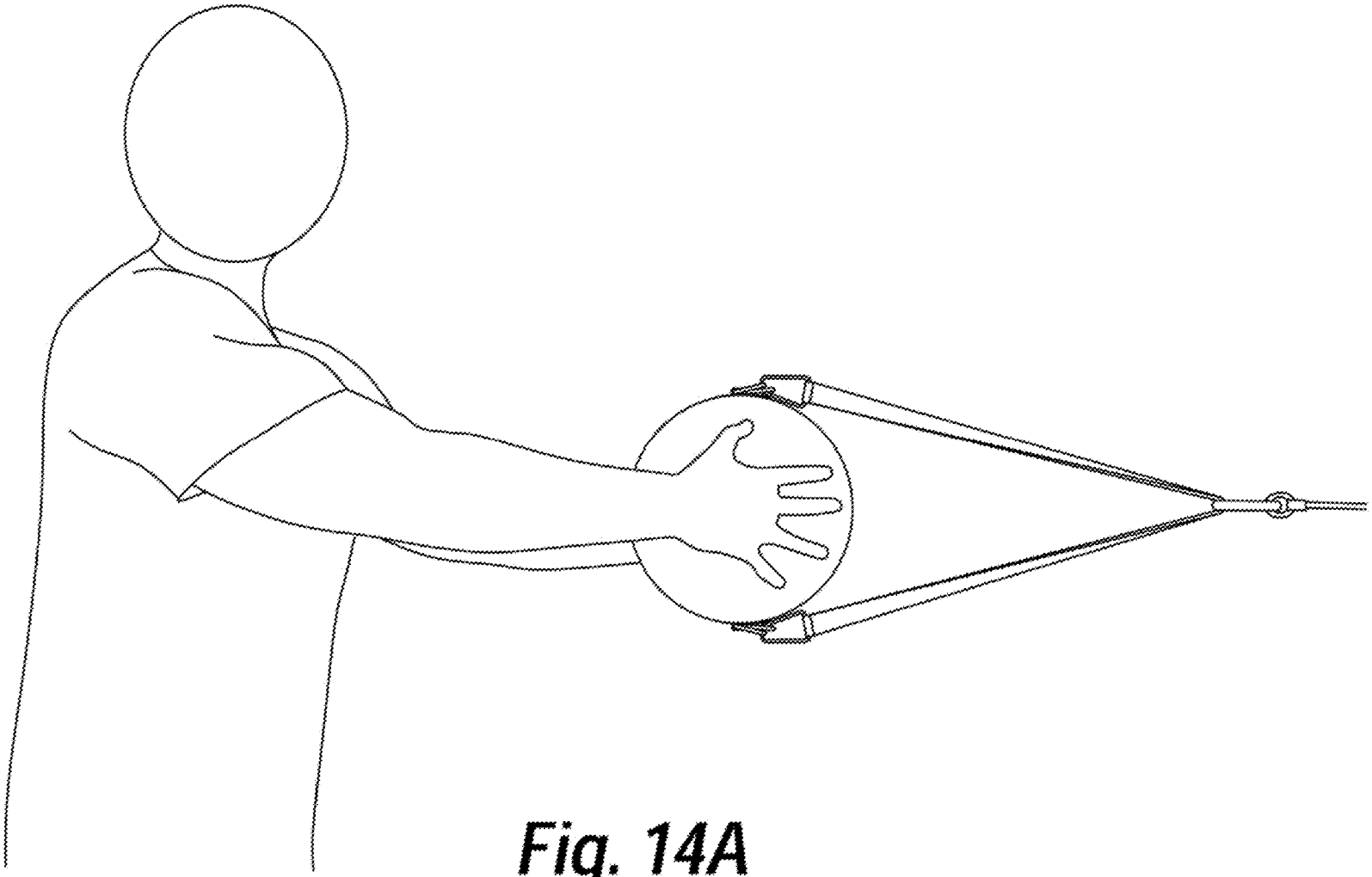
FIGS. 14A-B through FIGS. 21A-B are pictorial diagrams of a subject undergoing different exemplary exercises that can be able to be performed using the multi-modal portable exercise equipment of the present invention.
Figure 14B:
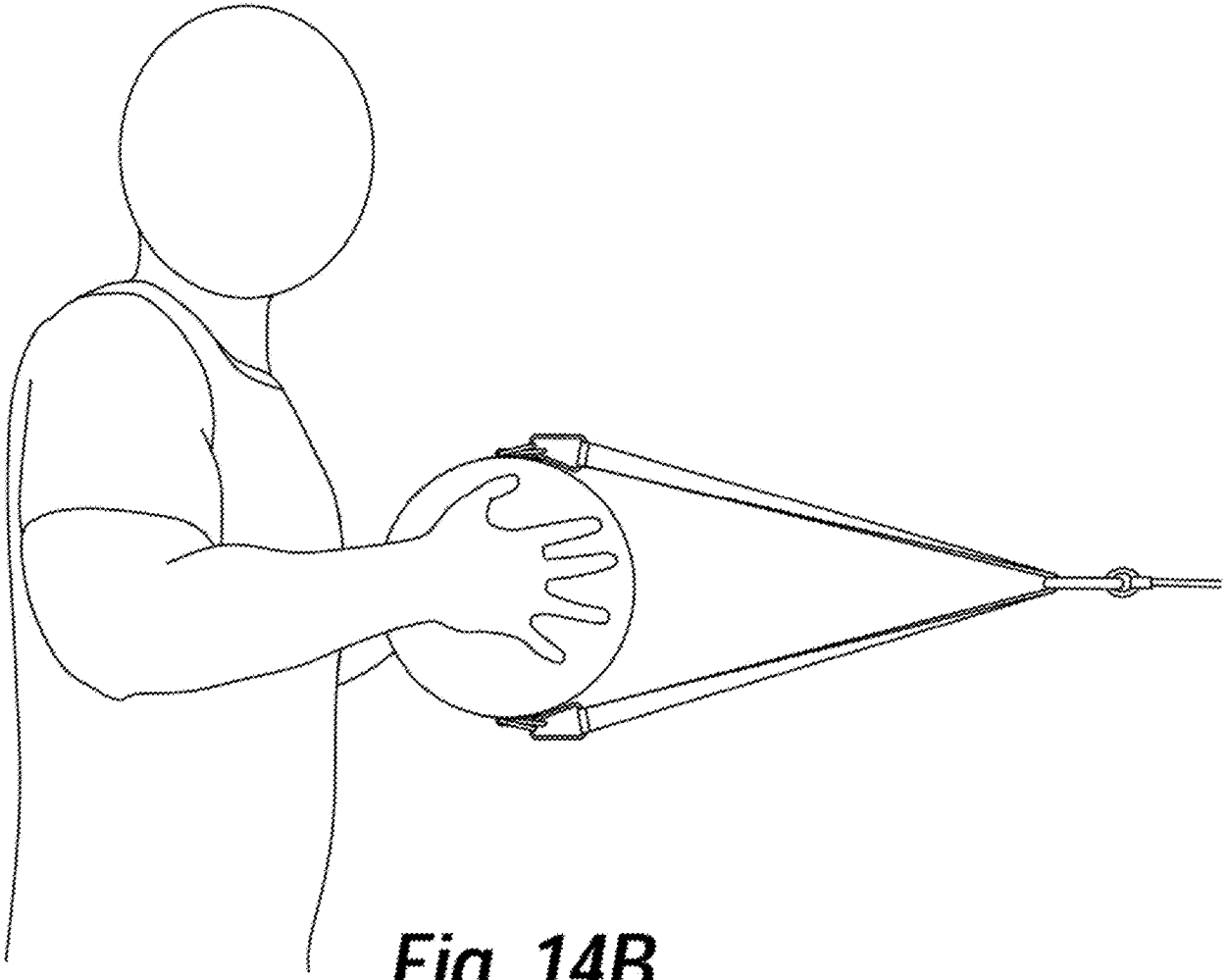

FIGS. 14A-B through FIGS. 21A-B are pictorial diagrams of a subject undergoing different exemplary exercises that can be able to be performed using the multi-modal portable exercise equipment of the present invention FIGS. 14A-B illustrate a subject undergoing a squatted horizontal cable row exercise.

Figure 15A:
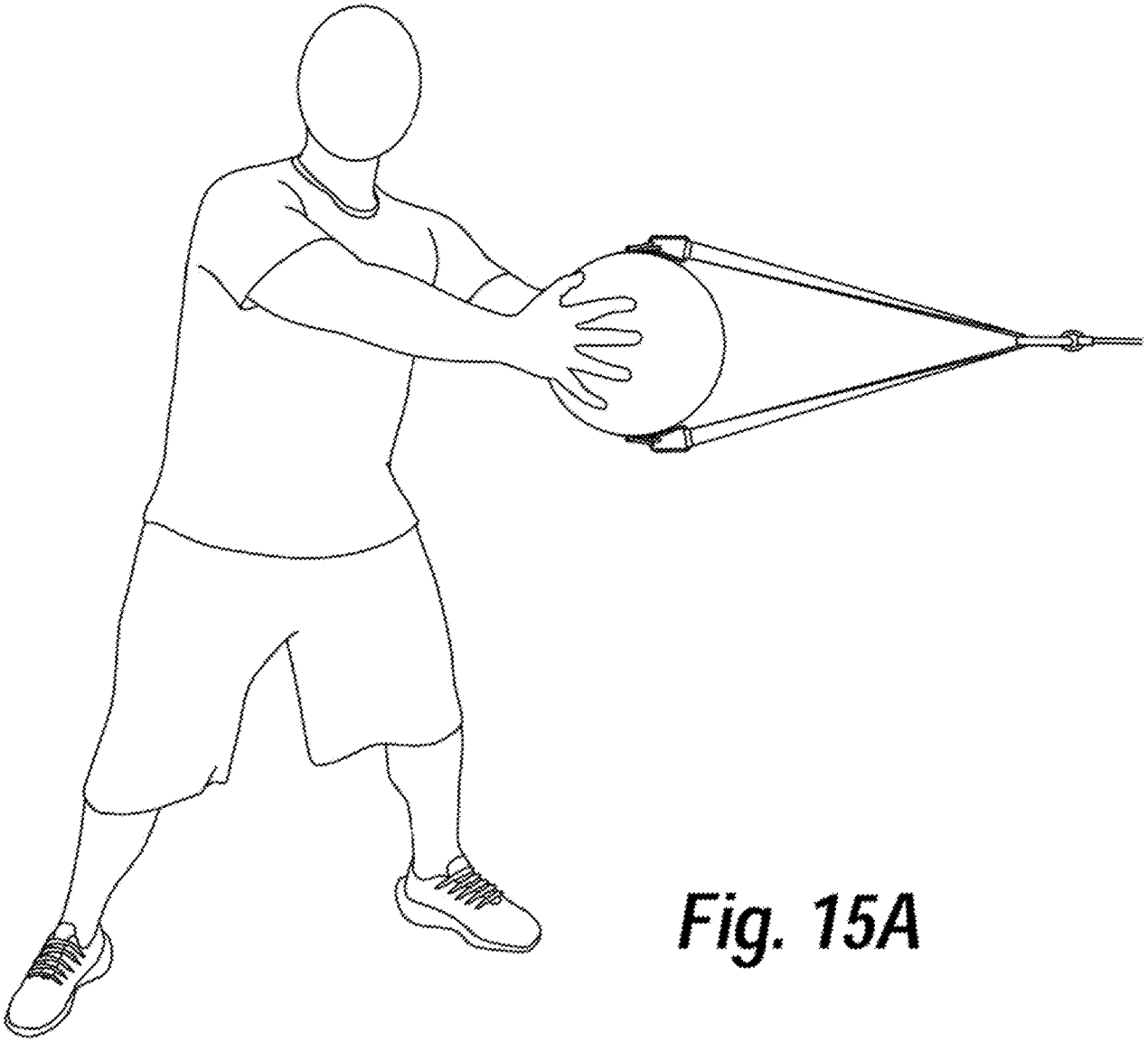
Figure 15B:
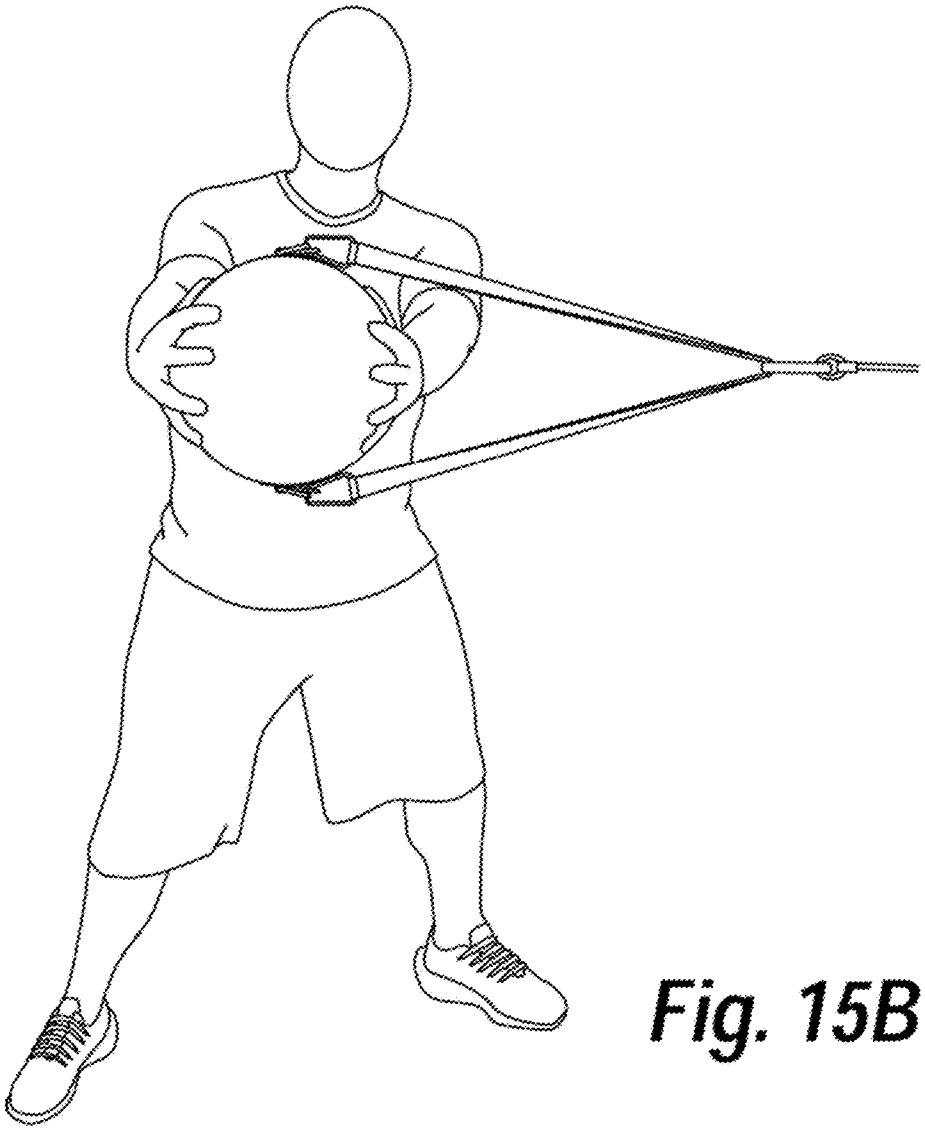

FIGS. 15A-B illustrate a subject undergoing a squatted horizontal cable court twist exercise.

Figure 16A:
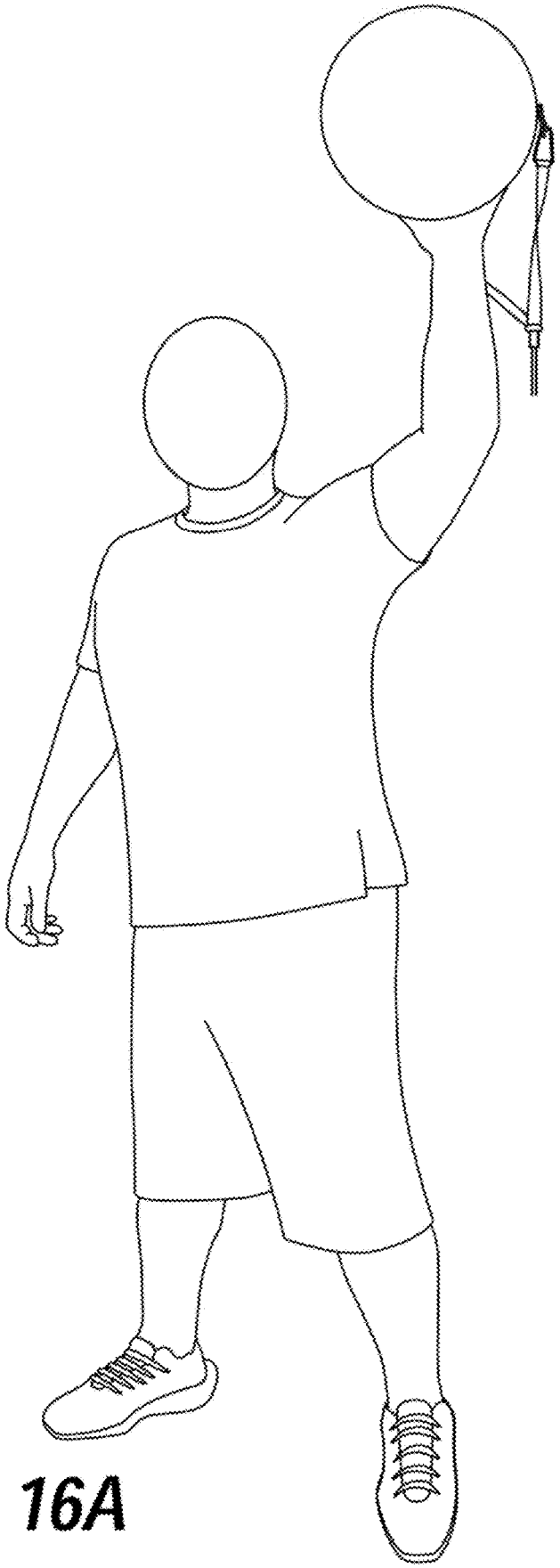
Figure 16B:
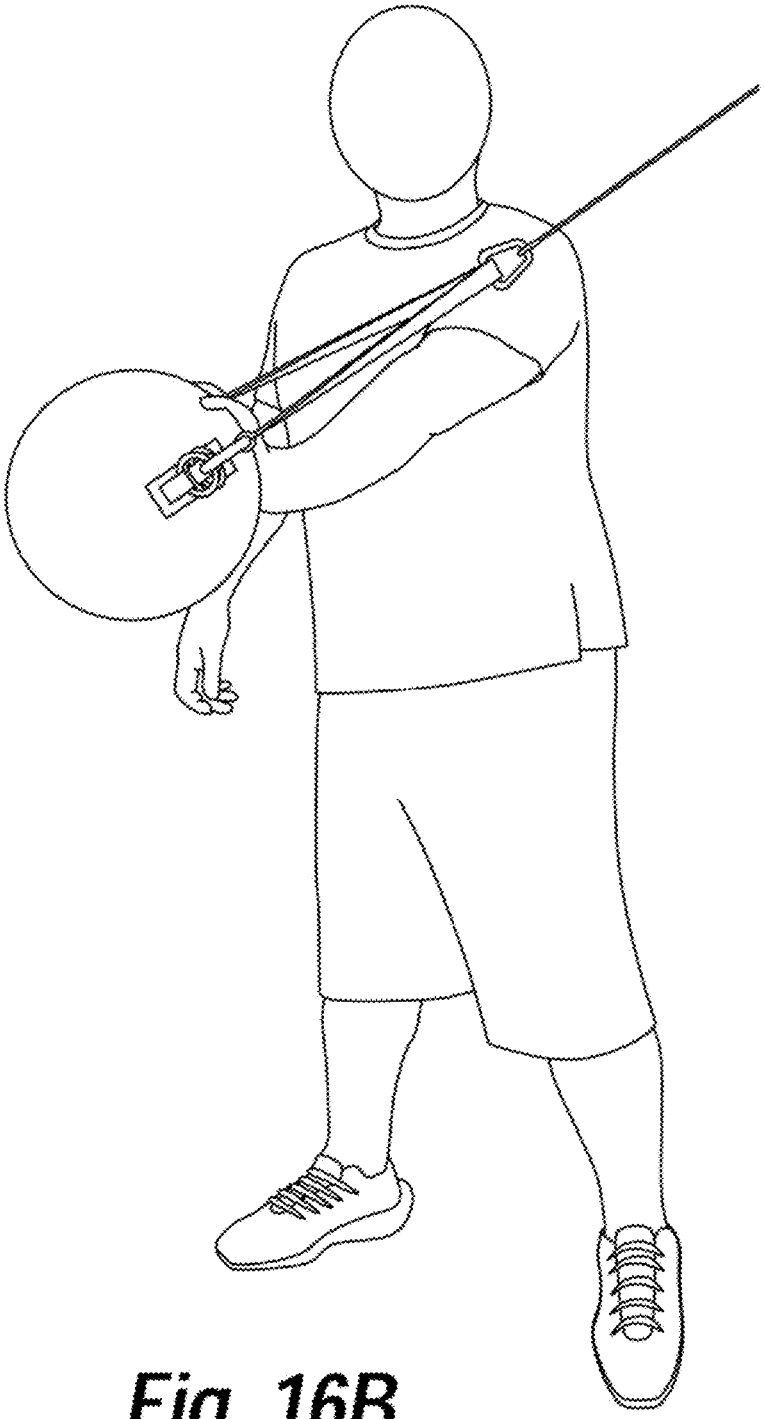

FIGS. 16A-B illustrate a subject undergoing a squatted, single arm cable diagonal throw exercise.

Figure 17A:
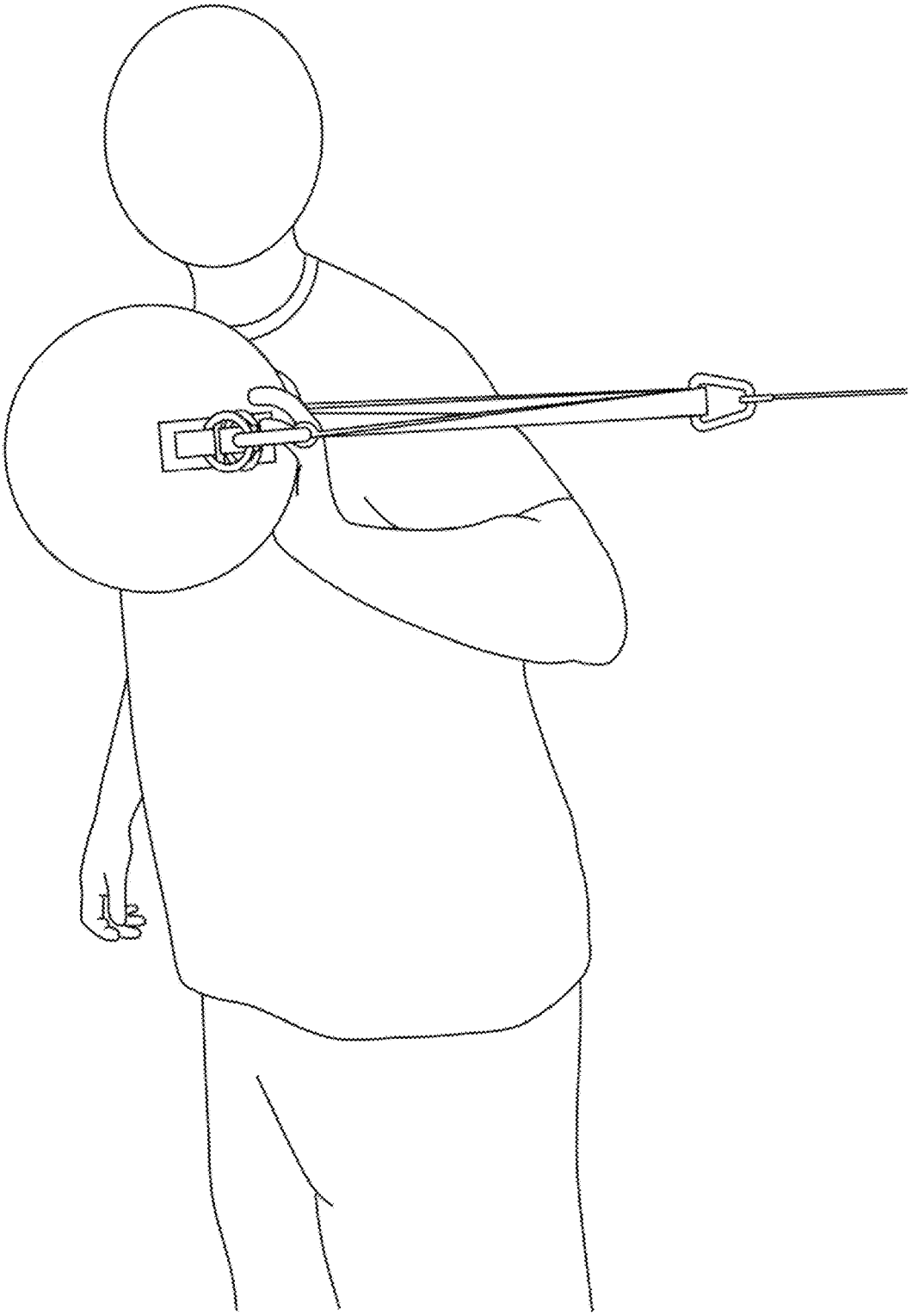
Figure 17B:
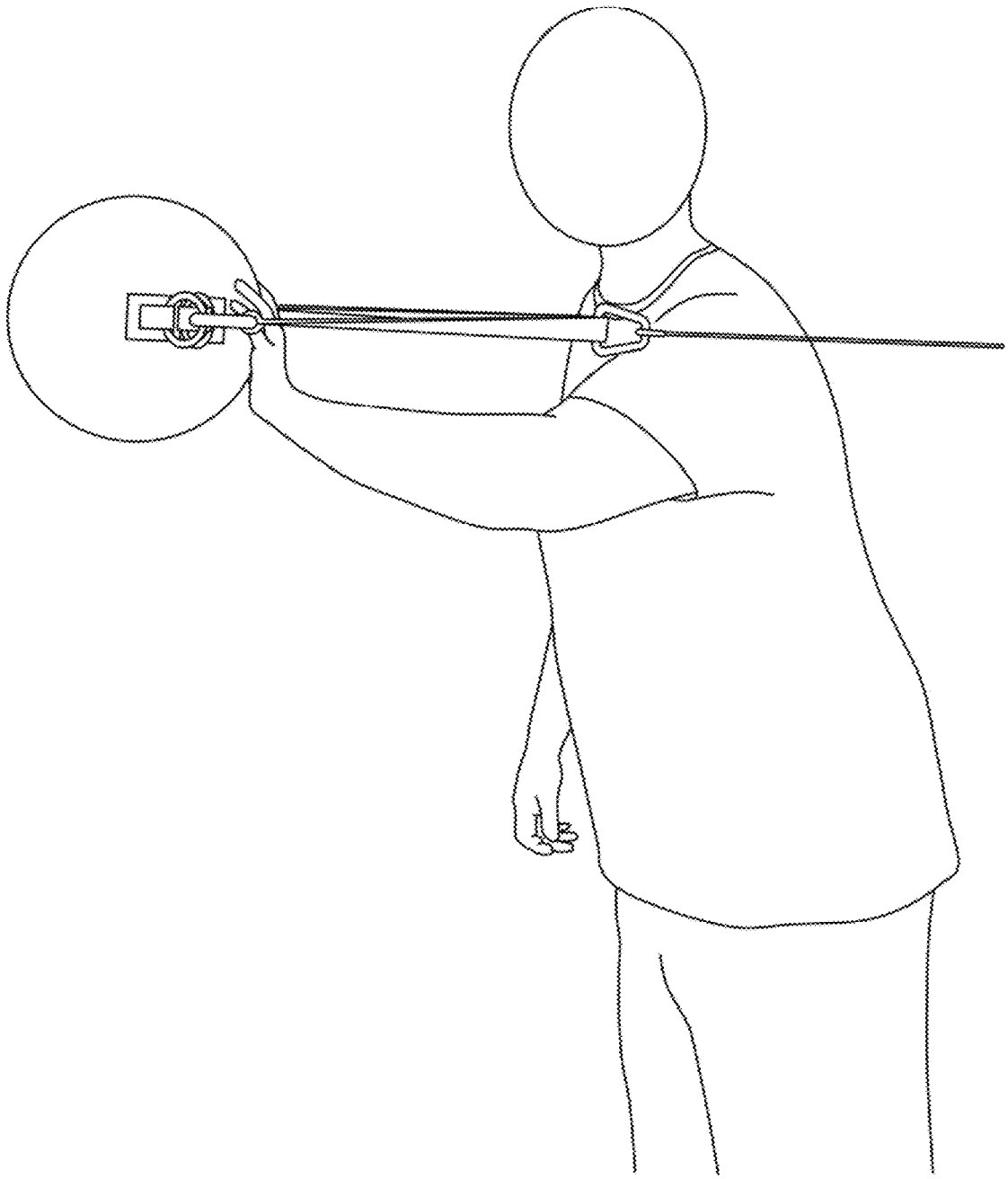

FIGS. 17A-B illustrate a subject undergoing a horizontal cable press exercise.

Figure 18A:
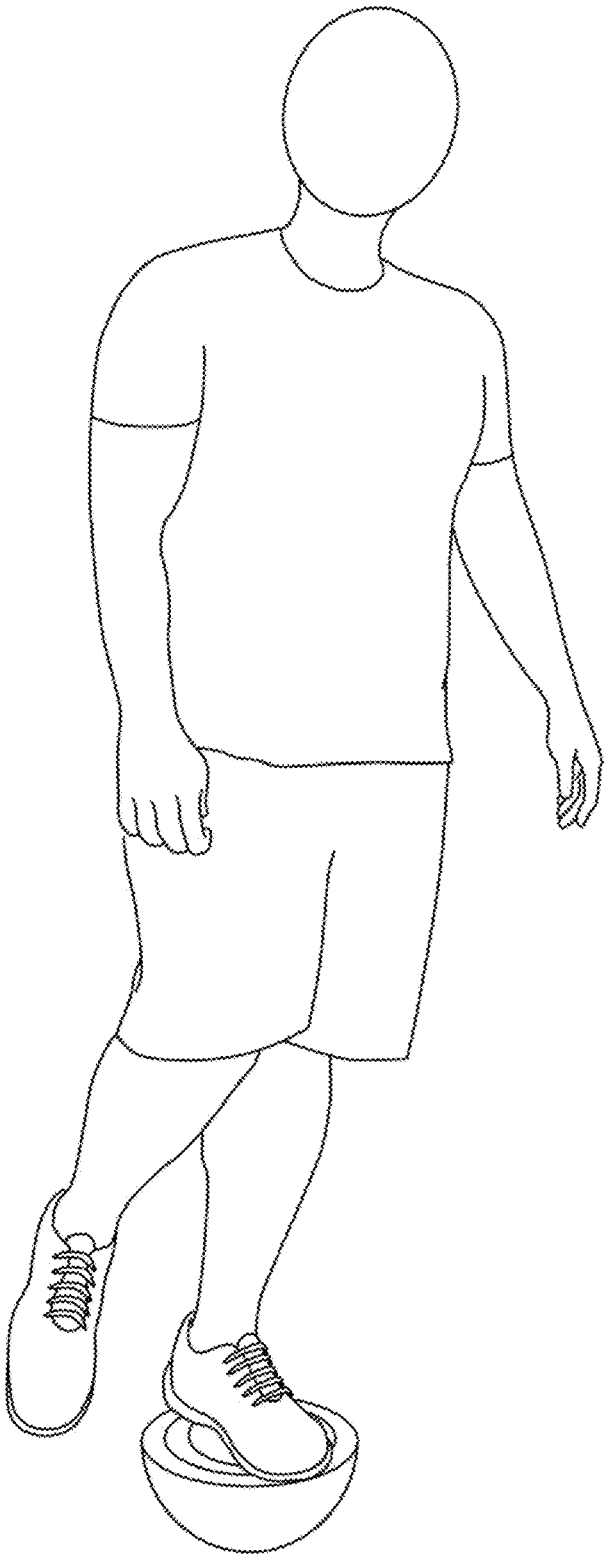
Figure 18B:
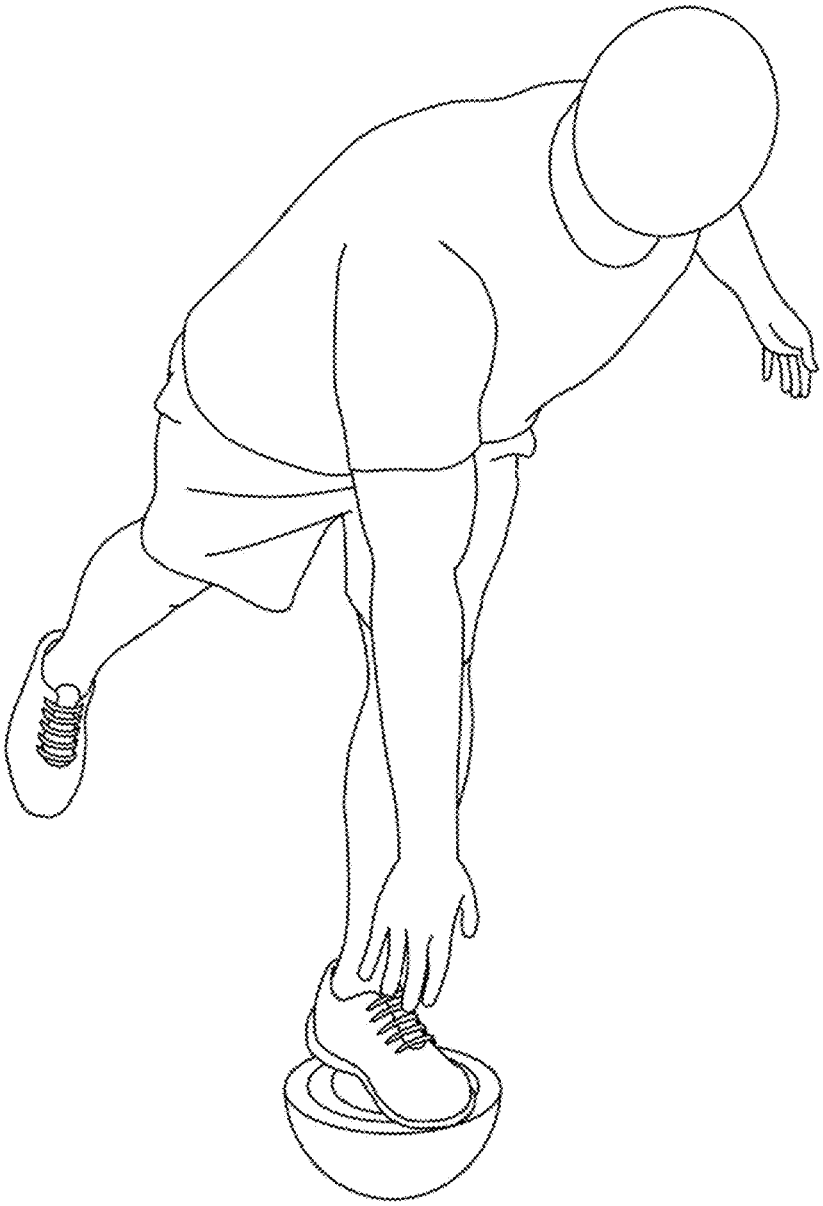

FIGS. 18A-B illustrate a subject undergoing a single leg dead lift exercise.

Figure 19A:
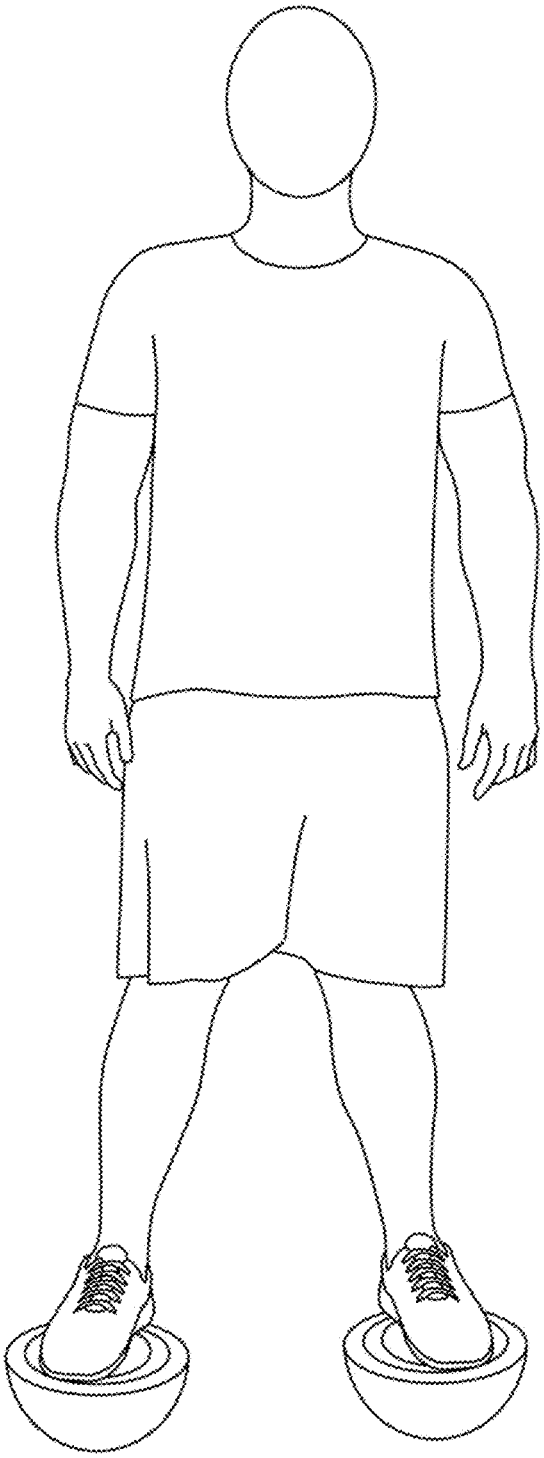
Figure 19B:
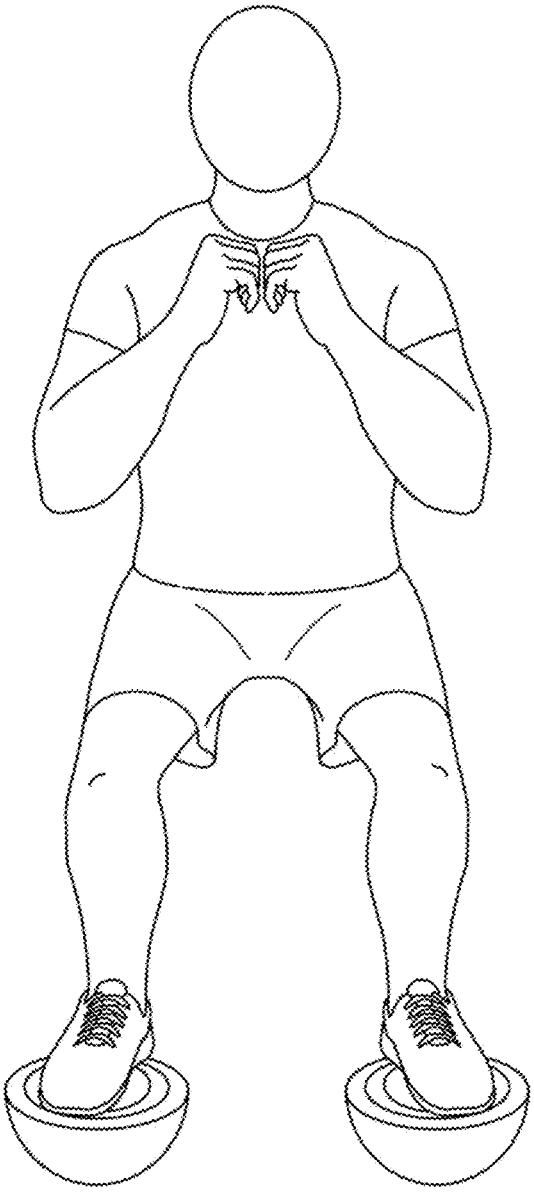

FIGS. 19A-B illustrate a subject undergoing a squats exercise.

Figure 20A:
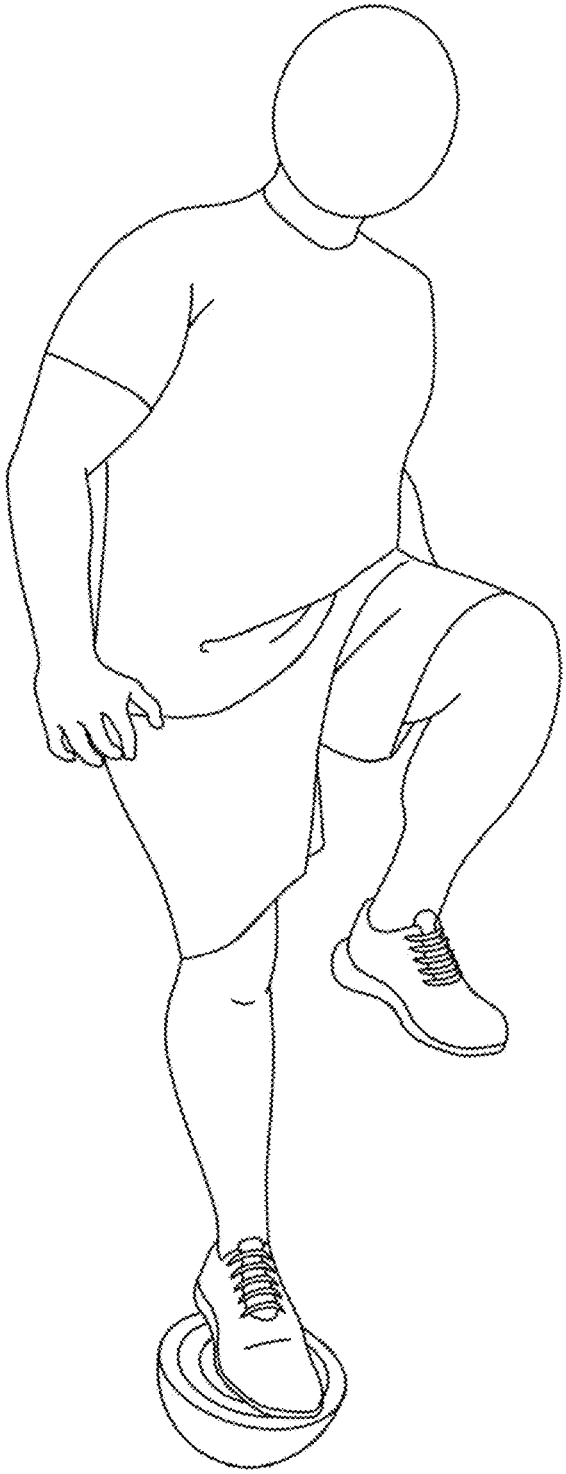
Figure 20B:
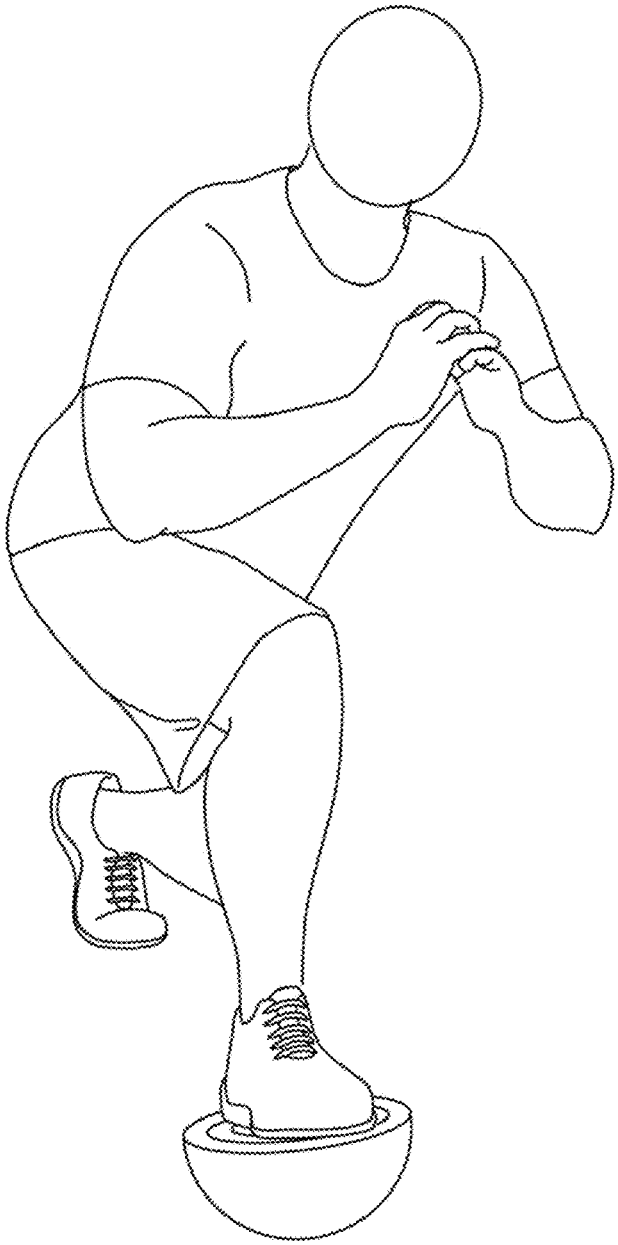

FIGS. 20A-B illustrate a subject undergoing a reverse lunge knee up exercise.

Figure 21A:
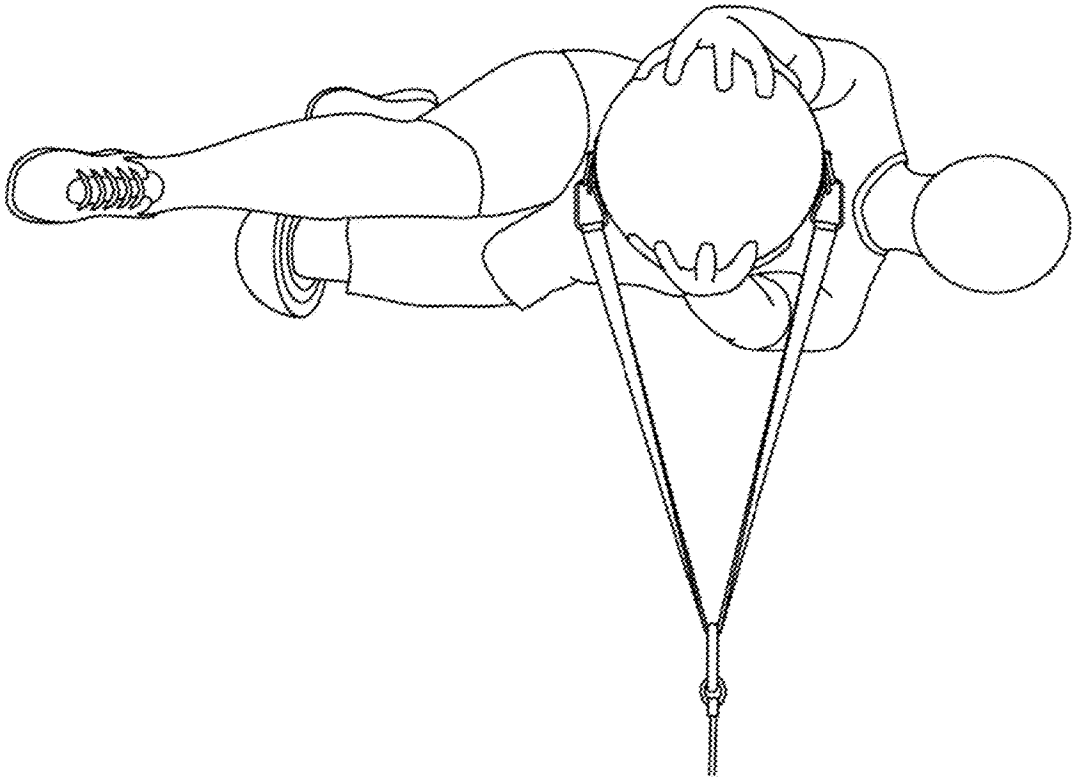
Figure 21B:
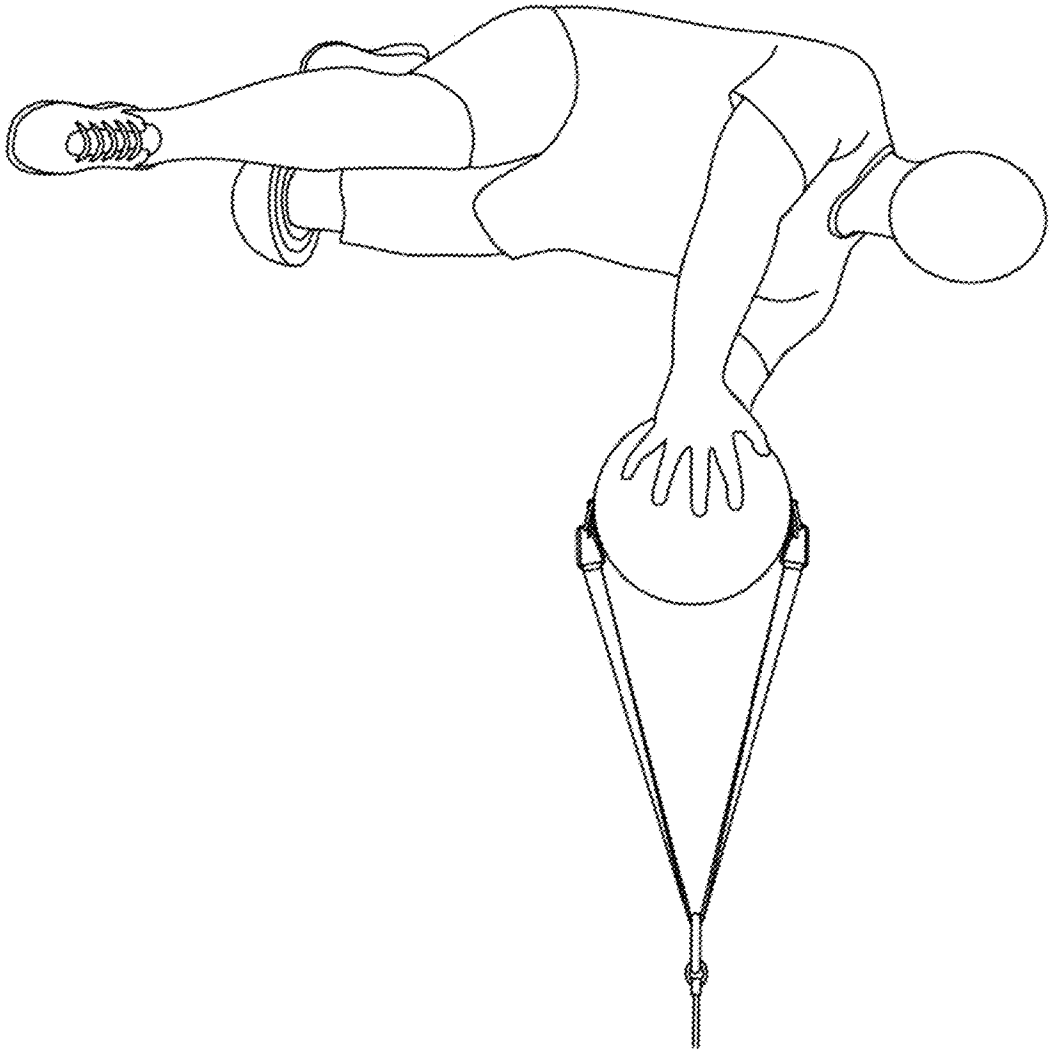

FIGS. 21A-B illustrate a subject undergoing a half kneel cable rotation twist exercise.

Many modifications, alternative constructions and/or different embodiments will become apparent to those of skill in the art having had the benefit of the instant disclosure. In different embodiments and modifications the shape of its constitutive half bodies in mated condition may be other than spherical or oval so long as it is hand-holdable; the enveloping skin with provision for band or cable attachment may be other than spherical or oval shaped to receive a football or other shape to receive other sports ball; the first and second force balancing strips may be a single stripe (or another arrangement) that extends between the antipodal attachment members around the skin in an equatorial plane; the constitutive freestanding half bodies of the exercise ball in their unmated condition may be other than hemispherical so long as each half body has opposing stable and metastable surfaces for use in balance training; and the attachment member for releasably hooking the generally spherical exercise ball to external bands and cables may be other than carried on an enclosing skin and may be individually provided on each constitutive exercise half body thereof without departing from the inventive concepts.

What is claimed is:

1. A portable exercise equipment that can be used by a subject with an exercise machine's cable or resistance band that provide resistance for strength and other allied training exercises, comprising:

a skin adapted to receive a ball therewithin;

first and second attachment members carried on opposing sides of said skin adapted to removably attach the skin to one of said exercise machine's cable and resistance band in such a way as to enable said subject to hold said skin adapted to receive the ball therewithin with one or two hands and to so move said skin adapted to receive the ball therewithin against said resistance of said exercise machine's cable or resistance band as to perform said strength and other allied training exercises;

wherein said skin has an inside and an outside; and a force balancing stripe, mounted inside of said skin, that extends between said first and second attachment members in a common plane on opposing sides of said skin.

2. The portable exercise equipment that can be used by said subject with said exercise machine's cable or said resistance band that provide resistance for said strength and said other allied training exercises of claim 1, wherein the skin is adapted to removably receive said ball therewithin.

3. The portable exercise equipment that can be used by said subject with said exercise machine's cable or said resistance band that provide resistance for said strength and said other allied training exercises of claim 2, wherein the skin is circumferentially zippered to removably receive said ball therewithin, and wherein each said first and second attachment members includes an O-ring, wherein said exercise machine's cable or said resistance band has a free end and a carabineer on said end thereof, and further including a strap that cooperates with said O-rings and said carabiner on said free end of said cable or resistance band to attach said exercise machine's cable or said resistance band to said skin via said first and second attachment members.

4. The portable exercise equipment that can be used by said subject with said exercise machine's cable or said resistance band that provide resistance for said strength and said other allied training exercises of claim 1, wherein said skin is a generally spherical skin.

5. The portable exercise equipment that can be used by said subject with said exercise machine's cable or said resistance band that provide resistance for said strength and said other allied training exercises of claim 1, wherein said first and second attachment members on opposing sides of the skin respectively include first and second pairs of O-rings.

6. The portable exercise equipment that can be used by said subject with said exercise machine's cable or said resistance band that provide resistance for said strength and said other allied training exercises of claim 1, wherein said ball is an ordinary sports ball.

7. The portable exercise equipment that can be used by said subject with said exercise machine's cable or said resistance band that provide resistance for said strength and said other allied training exercises of claim 1, wherein said skin has an inside arcuate surface and wherein said stripe is attached along its length to said inside arcuate surface of said skin.

8. The portable exercise equipment that can be used by said subject with said exercise machine's cable or said resistance band that provide resistance for said strength and said other allied training exercises of claim 1, wherein said stripe includes first and second force balancing strips that respectively extend between the first and second attachment members in a common plane on opposing sides of the skin.

* * * * *